US007433639B2

(12) United States Patent
Yasuda et al.

(10) Patent No.: US 7,433,639 B2
(45) Date of Patent: Oct. 7, 2008

(54) FIXING DEVICE

(75) Inventors: Akihiro Yasuda, Osaka (JP); Noboru Katakabe, Kyoto (JP); Noriyuki Tajima, Osaka (JP); Keisuke Fujimoto, Osaka (JP); Masaru Imai, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 225 days.

(21) Appl. No.: 10/575,356

(22) PCT Filed: Oct. 5, 2004

(86) PCT No.: PCT/JP2004/014648

§ 371 (c)(1),
(2), (4) Date: Apr. 11, 2006

(87) PCT Pub. No.: WO2005/038533

PCT Pub. Date: Apr. 28, 2005

(65) Prior Publication Data

US 2007/0014601 A1 Jan. 18, 2007

(30) Foreign Application Priority Data

Oct. 17, 2003 (JP) ..... 2003-358024
Oct. 17, 2003 (JP) ..... 2003-358330
May 25, 2004 (JP) ..... 2004-155165

(51) Int. Cl.
*G03G 15/20* (2006.01)

(52) U.S. Cl. ..... 399/329; 219/619

(58) Field of Classification Search ..... 399/328, 399/329; 219/216, 619
See application file for complete search history.

(56) References Cited

U.S. PATENT DOCUMENTS

| | | | |
|---|---|---|---|
| 5,752,148 | A | 5/1998 | Yoneda et al. |
| 7,122,768 | B2 | 10/2006 | Imai et al. |
| 7,194,234 | B2 | 3/2007 | Katakabe et al. |
| 2002/0190060 | A1 | 12/2002 | Imai et al. |
| 2003/0086736 | A1 | 5/2003 | Sekiguchi et al. |
| 2004/0169036 | A1 | 9/2004 | Katakabe et al. |

(Continued)

FOREIGN PATENT DOCUMENTS

JP 10-074009 3/1998

(Continued)

OTHER PUBLICATIONS

English Language Abstract of JP 10-074009.

(Continued)

*Primary Examiner*—Ryan Gleitz
(74) *Attorney, Agent, or Firm*—Greenblum & Bernstein, P.L.C.

(57) ABSTRACT

In a fixing apparatus using an induction heating type of heating apparatus, there are provided an excitation apparatus that generates magnetic flux, an opposed core located opposite the excitation apparatus, a fixing belt that is induction-heated by the aforementioned magnetic flux, and magnetism masking elements that block magnetic paths corresponding to paper non-passage areas of fixing belt between the excitation apparatus and the opposed core. By blocking magnetic paths between the excitation apparatus and the opposed core by the magnetism masking elements, magnetic flux that induction-heats the fixing belt is effectively masked, and an excessive rise in temperature of paper non-passage areas of fixing belt is prevented.

38 Claims, 23 Drawing Sheets

U.S. PATENT DOCUMENTS

| | | | |
|---|---|---|---|
| 2004/0253887 | A1 | 12/2004 | Katakabe et al. |
| 2005/0199613 | A1 | 9/2005 | Samei et al. |
| 2005/0201768 | A1 | 9/2005 | Tatematsu et al. |
| 2006/0072931 | A1 | 4/2006 | Asakura et al. |
| 2006/0099001 | A1 | 5/2006 | Asakura et al. |

FOREIGN PATENT DOCUMENTS

| | | | | |
|---|---|---|---|---|
| JP | 2000-268952 | | | 9/2000 |
| JP | 2001125407 | A | * | 5/2001 |
| JP | 2002-040843 | | | 2/2002 |
| JP | 2002-148983 | | | 5/2002 |
| JP | 2003-7438 | | | 1/2003 |
| JP | 2003077645 | A | * | 3/2003 |
| JP | 2003-123961 | | | 4/2003 |
| WO | WO0229498 | A | * | 4/2002 |
| WO | 03/039197 | | | 5/2003 |

OTHER PUBLICATIONS

English Language Abstract of JP 2003-123961.
U.S. Appl. No. 10/575,353 to Yasuda et al., filed Apr. 11, 2006.
U.S. Appl. No. 10/565,270 to Yasuda et al., filed Apr. 11, 2006.
U.S. Appl. No. 10/576,307 to Samei et al., filed Apr. 11, 2006.
English language Abstract of JP 2002-148983.

* cited by examiner

FIXING DEVICE

TECHNICAL FIELD

The present invention relates to a fixing apparatus useful for employment in an image forming apparatus such as an electrophotographic or electrostatographic copier, facsimile machine, or printer, and more particularly to a fixing apparatus that heat-fixes an unfixed image onto a recording medium using an induction heating type of heating section.

BACKGROUND ART

An induction heating (IH) type of fixing apparatus generates an eddy current through the action of a magnetic field generated by a magnetic field generation unit in a heat-producing element, and heat-fixes an unfixed image on a recording medium such as transfer paper or an OHP sheet through Joule heating occurring in the heat-producing element due to this eddy current.

An advantage of this induction heating type of fixing apparatus compared with a heat roller type of fixing apparatus that uses a halogen lamp as a heat source is that heat production efficiency is higher and the fixing speed can be increased.

A fixing apparatus that uses a thin heat-producing element comprising a thin sleeve or endless belt as the heat-producing element is known. With such a fixing apparatus, the thermal capacity of the heat-producing element is low and the heat-producing element can be made to produce heat in a short time, enabling startup responsiveness until heat production at a predetermined fixing temperature to be markedly improved.

On the other hand, with a fixing apparatus that uses this kind of heat-producing element of low thermal capacity, heat is lost simply through the passage of a recording medium, causing a drop in temperature of the paper passage area. Therefore, with this kind of fixing apparatus, the heat-producing element is heated in a timely fashion so that the temperature of the paper passage area is maintained at a predetermined fixing temperature.

Consequently, with a fixing apparatus that uses this kind of heat-producing element of low thermal capacity, if a recording medium of small size is fed through continuously, the heat-producing element is continuously heated, and a phenomenon whereby the temperature of a paper non-passage area becomes abnormally higher than the temperature of a paper passage area-that is, a phenomenon of an excessive rise in temperature of a paper non-passage area-occurs.

A known technology for eliminating this kind of phenomenon of an excessive rise in temperature of a paper non-passage area is one whereby, of the magnetic flux generated by an exciting apparatus that performs induction heating of the heat-producing element, only magnetic flux that acts on a paper non-passage area of the heat-producing element is absorbed by a magnetic flux absorption member capable of moving in the heat production width direction of the heat-producing element (see, for example, Patent Document 1).

Another known technology for eliminating the above-described phenomenon of an excessive rise in temperature of the paper non-passage area is one whereby a second core of magnetic material corresponding to a paper non-passage area is positioned at the rear of a first core of magnetic material of a magnetic flux generation section that causes heat generation of a heat-producing element by electromagnetic induction, and the lengthwise temperature distribution of the heat-producing element is changed by varying the gap between the first core of magnetic material and second core of magnetic material (see, for example, Patent Document 2).

FIG. 1 is a schematic oblique drawing of an embodiment of a fixing apparatus disclosed in Patent Document 1. As shown in FIG. 1, this fixing apparatus is provided with a coil assembly 10, a metal sleeve 11, a holder 12, a pressure roller 13, a magnetic flux masking shield 31, a displacement mechanism 40, and so forth.

In FIG. 1, coil assembly 10 generates a high-frequency magnetic field. Metal sleeve 11 is heated by an induction current induced by an induction coil 18 of coil assembly 10, and rotates in the direction of transportation of recording material 14. Coil assembly 10 is held inside holder 12. Holder 12 is fixed to a fixing unit frame (not shown) and does not rotate. Pressure roller 13 rotates in the direction of transportation of recording material 14 while pressing against metal sleeve 11 and forming a nip area. By having recording material 14 gripped and transported by means of this nip area, an unfixed image on recording material 14 is heat-fixed to recording material 14 by heated metal sleeve 11.

As shown in FIG. 1, magnetic flux masking shield 31 exhibits an arc-shaped curved surface that mainly covers the upper half of induction coil 18, and is advanced and withdrawn with respect to the gap at either end of coil assembly 10 and holder 12 by means of displacement mechanism 40. Displacement mechanism 40 has a wire 33 linked to magnetic flux masking shield 31, a pair of pulleys 36 on which wire 33 is suspended, and a motor 34 that rotates one of the pulleys 36.

When the size of recording material 14 is the maximum size, magnetic flux masking shield 31 is moved by means of displacement mechanism 40 so as to be withdrawn into the position shown by the solid line in FIG. 1. On the other hand, when the size of recording material 14 is small, magnetic flux masking shield 31 is moved so as to advance into the position shown by the dot-dot-dash line in FIG. 1. By this means, magnetic flux reaching a paper non-passage area of metal sleeve 11 from induction coil 18 is masked, and an excessive rise in temperature of a paper non-passage area is suppressed.

FIG. 2A and FIG. 2B are schematic cross-sectional views of a embodiment of a fixing apparatus disclosed in Patent Document 2. As shown in FIG. 2A and FIG. 2B, this fixing apparatus is provided with a heating assembly 51, a holder 52, a core-holding rotating member 53, an exciting coil 54, a first core 55, a second core 56, a fixing roller 57, a pressure roller 58, and so forth.

In FIG. 2A and FIG. 2B, heating assembly 51 is composed of holder 52, core-holding rotating member 53, exciting coil 54, first core 55, and second core 56, and generates magnetic flux. Fixing roller 57 is induction-heated through the action of magnetic flux generated by heating assembly 51, and rotates in the direction of transportation of recording material 59.

Pressure roller 58 rotates in the direction of transportation of recording material 59 while pressing against fixing roller 57 and forming a nip area. By having recording material 59 gripped and transported by means of this nip area, an unfixed image on recording material 59 is heat-fixed to recording material 59 by heated fixing roller 57.

First core 55 has the same width as the width of the maximum paper passage area of fixing roller 57. When the size of recording material 59 is the maximum size, second core 56 is moved to a position close to first core 55, as shown in FIG. 2A. On the other hand, when the size of recording material 59 is small, core-holding rotating member 53 rotates through 180 degrees and second core 56 is moved to a position away from first core 55, as shown in FIG. 2B. By this means, heat production of a paper non-passage area of fixing roller 57 corresponding to second core 56 is suppressed.

Patent Document 1: Unexamined Japanese Patent Publication No. HEI10-74009

Patent Document 2: Unexamined Japanese Patent Publication No. 2003-123961

DISCLOSURE OF INVENTION

Problems to be Solved by the Invention

However, as the fixing apparatus disclosed in Patent Documents 1 has a configuration whereby magnetic flux masking shield 31 is advanced and withdrawn with respect to the gap at either end of coil assembly 10 and holder 12 by means of displacement mechanism 40, there is a problem in that the pair of pulleys 36 of displacement mechanism 40 project greatly from either end of holder 12, as shown in FIG. 1, and the body of the fixing apparatus is correspondingly large. Also, as shown in FIG. 1, a fixing apparatus disclosed in Patent Document 1 has a configuration whereby magnetic flux masking shield 31 is positioned between metal sleeve 11 formed of magnetic material and induction coil 18. In a fixing apparatus that uses induction heating, it is necessary to keep the gap between induction coil 18 and metal sleeve 11 narrow—on the order of 1 mm, for example—to increase magnetic coupling. It is necessary for magnetic flux masking shield 31 to be made thin in order to be inserted in this narrow gap. That is to say, there is a problem of electrical resistance increasing because magnetic flux masking shield 31 cannot be made sufficiently thick, and of magnetic flux masking shield 31 tending to produce heat itself. Although heat production due to eddy currents can be suppressed by forming through-holes 35 in magnetic flux masking shield 31, magnetic flux reaches metal sleeve 11 as a result, and a paper non-passage area of the metal sleeve produces heat. As a result, there is a problem in that when small-size recording material 14 is fed through continuously, heat is accumulated in a paper non-passage area of metal sleeve 11, and an excessive rise in temperature cannot be suppressed.

Also, as shown in FIG. 2A and FIG. 2B, in a fixing apparatus disclosed in Patent Document 2, the distance between first core 55 and fixing roller 57 does not vary even though second core 56 is displaced with respect to first core 55 by the rotation of core-holding rotating member 53, and therefore the magnetic gap between a paper passage area and paper non-passage area of fixing roller 57 is fixed.

Consequently, with this fixing apparatus, diverted flow of magnetic flux from the end of the paper passage area corresponding to first core 55 to the end of the paper non-passage area corresponding to second core 56 occurs, and the efficacy of magnetic flux suppression in a paper passage area of fixing roller 57 becomes low. As a result, a problem with this fixing apparatus is that when small-size recording material 59 is fed through continuously, heat is accumulated in a paper non-passage area of fixing roller 57, and an excessive rise in temperature cannot be effectively suppressed.

Also, with this fixing apparatus, only a second core 56 for one recording material size can be held in core-holding rotating member 53, and therefore the paper passage area width of fixing roller 57 can only be made to provide for two recording material paper widths—maximum size and small size.

It is therefore an object of the present invention to provide a small fixing apparatus that can eliminate diverted flow of magnetic flux from a paper passage area of a heat-producing member to a paper non-passage area, and prevent an excessive rise in temperature of the paper non-passage area.

MEANS FOR SOLVING THE PROBLEMS

A fixing apparatus of the present invention has: a magnetic flux generation section that generates magnetic flux; a heat-producing element of a nonmagnetic electrical conductor that allows passage of the aforementioned magnetic flux and is induction-heated; at least one magnetism masking element that masks the aforementioned magnetic flux; and a magnetic flux adjustment section that switches between masking and clearing of magnetic flux with respect to a paper non-passage area of the aforementioned heat-producing element; wherein the aforementioned magnetism masking element is located on the opposite side of the aforementioned heat-producing element from the aforementioned magnetic flux generation section.

ADVANTAGEOUS EFFECTS OF THE INVENTION

According to the present invention, a compact apparatus can be achieved, and diverted flow of magnetic flux from a paper passage area of a heat-producing element to a paper non-passage area can be eliminated, enabling an excessive rise in temperature of the paper non-passage area to be prevented.

BEST MODE FOR CARRYING OUT THE INVENTION

Figure 1:
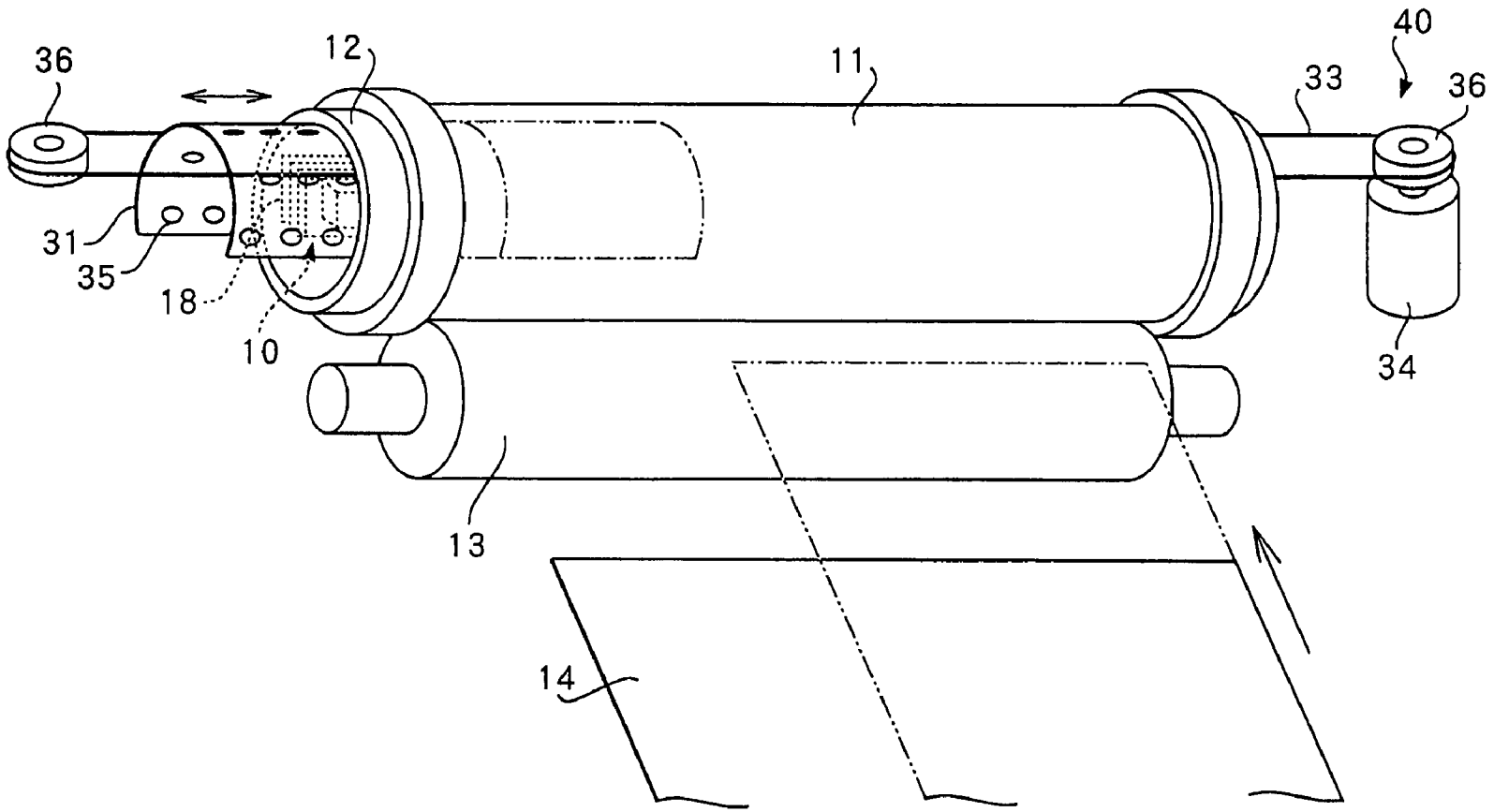
(PRIOR ART) FIG. 1
FIG. 1 is a schematic oblique drawing showing the configuration of a conventional fixing apparatus.
Figure 2A:
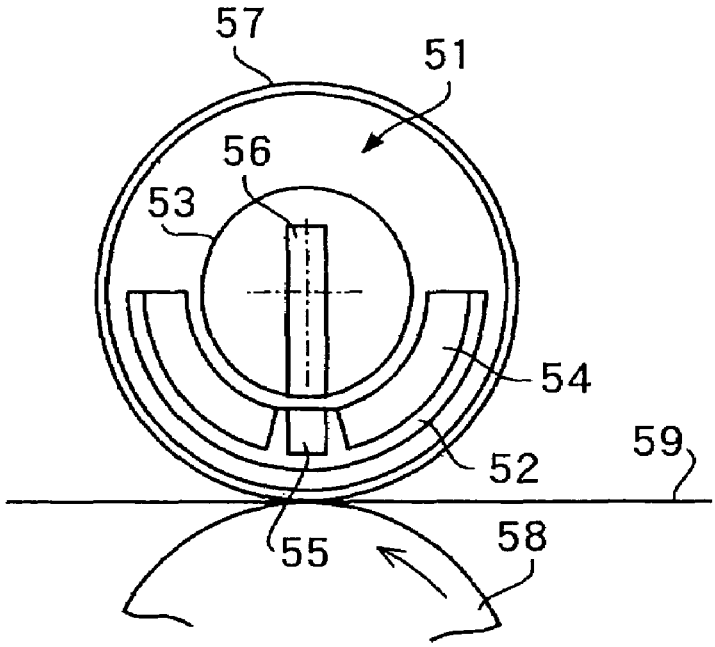
(PRIOR ART) FIG. 2A
FIG. 2A is a schematic cross-sectional view showing the configuration of the principal parts of another conventional fixing apparatus.
Figure 2B:
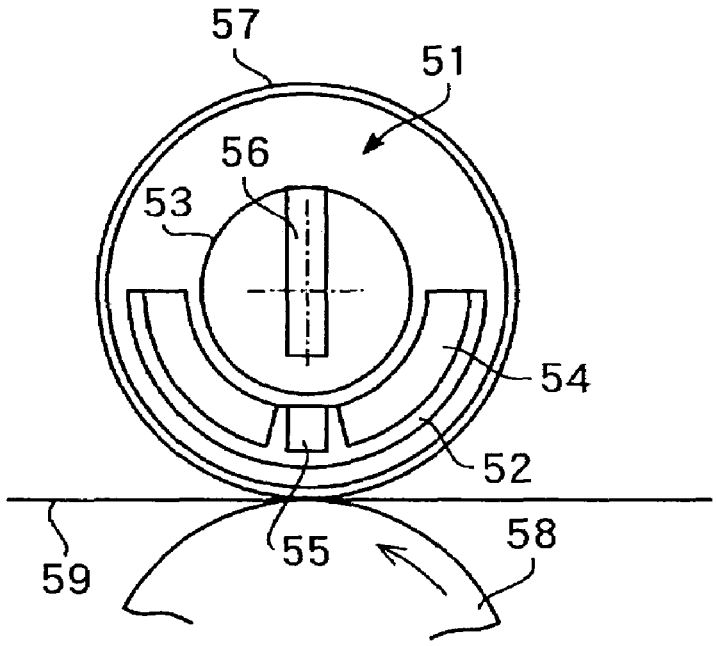
(PRIOR ART) FIG. 2B
FIG. 2B is a schematic cross-sectional view illustrating the operation of another conventional fixing apparatus.

The gist of the present invention is that a magnetism masking element is provided that is located in a freely movable fashion between a magnetic flux generation section and an opposed core and moves relative to the aforementioned magnetic flux generation section in the direction of movement of a heat-producing element that allows passage of magnetic flux, and blocks or clears a magnetic path corresponding to a paper non-passage area of the aforementioned heat-producing element between the aforementioned magnetic flux generation section and the aforementioned opposed core.

Embodiments of the present invention will now be described in detail with reference to the accompanying drawings. In the drawings, configuration elements and equivalent parts that have identical configurations or functions are assigned the same codes, and descriptions thereof are not repeated.

Embodiment 1

Figure 3:
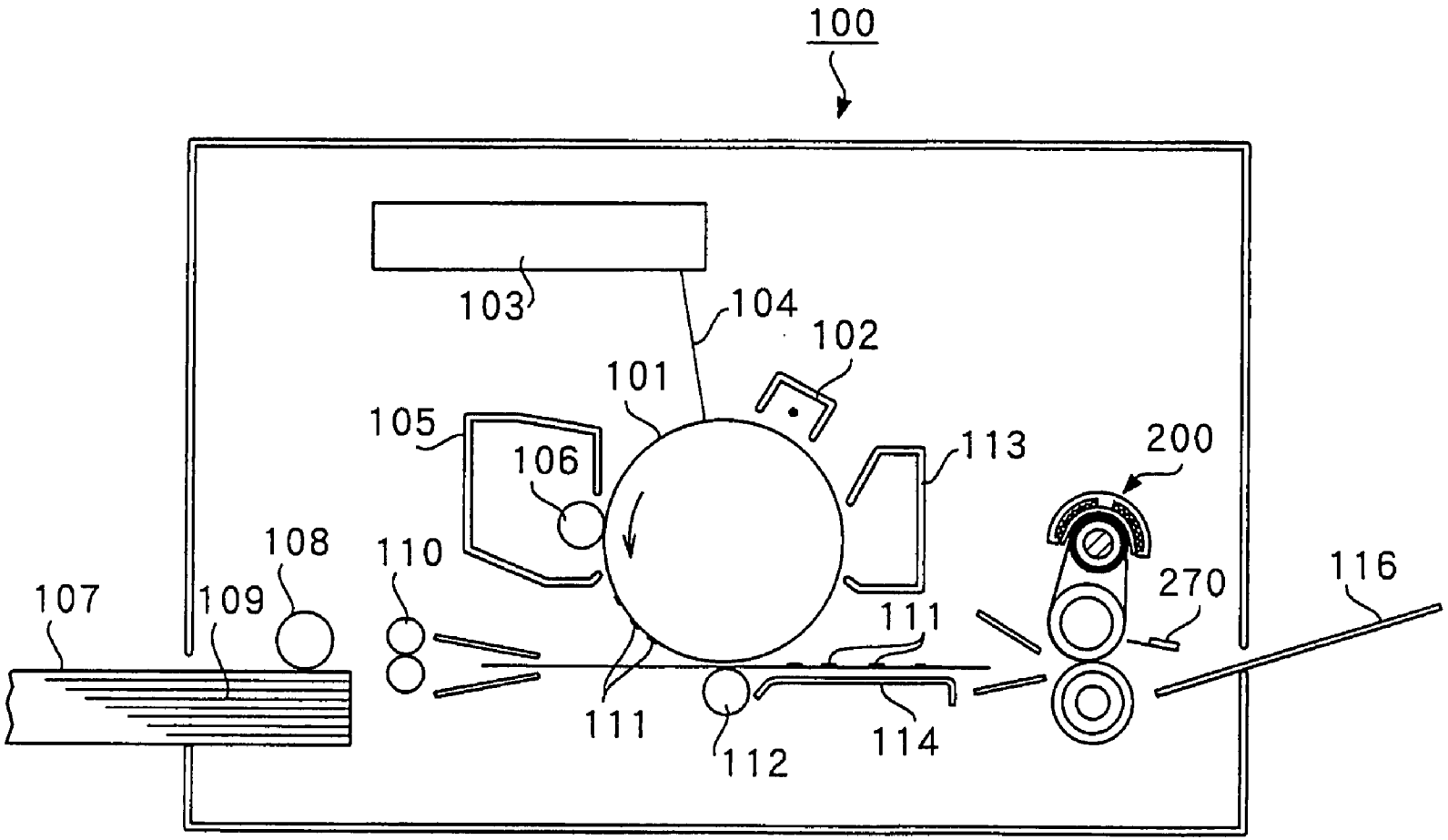
FIG. 3 is a schematic cross-sectional view showing the overall configuration of an image forming apparatus suitable for incorporation of a fixing apparatus according to Embodiment 1 of the present invention.

FIG. 3 is a schematic cross-sectional view showing the overall configuration of an image forming apparatus suitable for incorporation of a fixing apparatus according to Embodiment 1 of the present invention.

As shown in FIG. 3, an image forming apparatus 100 has an electrophotographic photosensitive body (hereinafter referred to as "photosensitive drum") 101, an electrifier 102, a laser beam scanner 103, a developing unit 105, a paper feed apparatus 107, a fixing apparatus 200, a cleaning apparatus 113, and so forth.

In FIG. 3, photosensitive drum 101 is rotated at a predetermined peripheral velocity in the direction indicated by the arrow while its surface is uniformly charged to a negative predetermined dark potential V0 by electrifier 102.

Laser beam scanner 103 outputs a laser beam 104 modulated in accordance with a time series electrical digital pixel signal of image information input from a host apparatus such as an image reading apparatus or computer (not shown), and performs scanning exposure of the surface of uniformly charged photosensitive drum 101 with laser beam 104. By this means, the absolute value of the potential of exposed parts of photosensitive drum 101 falls and becomes a light potential VL, and an electrostatic latent image is formed on the surface of photosensitive drum 101.

Developing unit 105 is provided with a rotated developing roller 106. Developing roller 106 is positioned opposite photosensitive drum 101, and a thin layer of toner is formed on its peripheral surface. A developing bias voltage with an absolute value smaller than dark potential V0 of photosensitive drum 101 and larger than light potential VL is applied to developing roller 106.

By this means, negatively charged toner on developing roller 106 adheres only to light potential VL parts of the surface of photosensitive drum 101, the electrostatic latent image formed on the surface of photosensitive drum 101 is developed, and an unfixed toner image 111 is formed on photosensitive drum 101.

Meanwhile, paper feed apparatus 107 feeds recording paper 109 as a recording medium one sheet at a time at predetermined timing by means of a paper feed roller 108. Recording paper 109 fed from paper feed apparatus 107 is transported through a pair of registration rollers 110 to the nip area between photosensitive drum 101 and a transfer roller 112 at appropriate timing synchronized with the rotation of photosensitive drum 101. By this means, unfixed toner image 111 on photosensitive drum 101 is transferred to recording paper 109 by transfer roller 112 to which a transfer bias is applied.

Recording paper 109 on which unfixed toner image 111 is formed and held in this way is guided by a recording paper guide 114 and separated from photosensitive drum 101, and then transported toward the fixing area of fixing apparatus 200. Once transported to this fixing area, recording paper 109 has unfixed toner image 111 heat-fixed onto it by fixing apparatus 200.

After passing through fixing apparatus 200, recording paper 109 onto which unfixed toner image 111 has been heat-fixed is ejected onto an output tray 116 attached to the outside of image forming apparatus 100.

After recording paper 109 has been separated from it, photosensitive drum 101 has residual material such as untransferred toner remaining on its surface removed by a cleaning apparatus 113, and is made ready for the next image forming operation.

Figure 4:
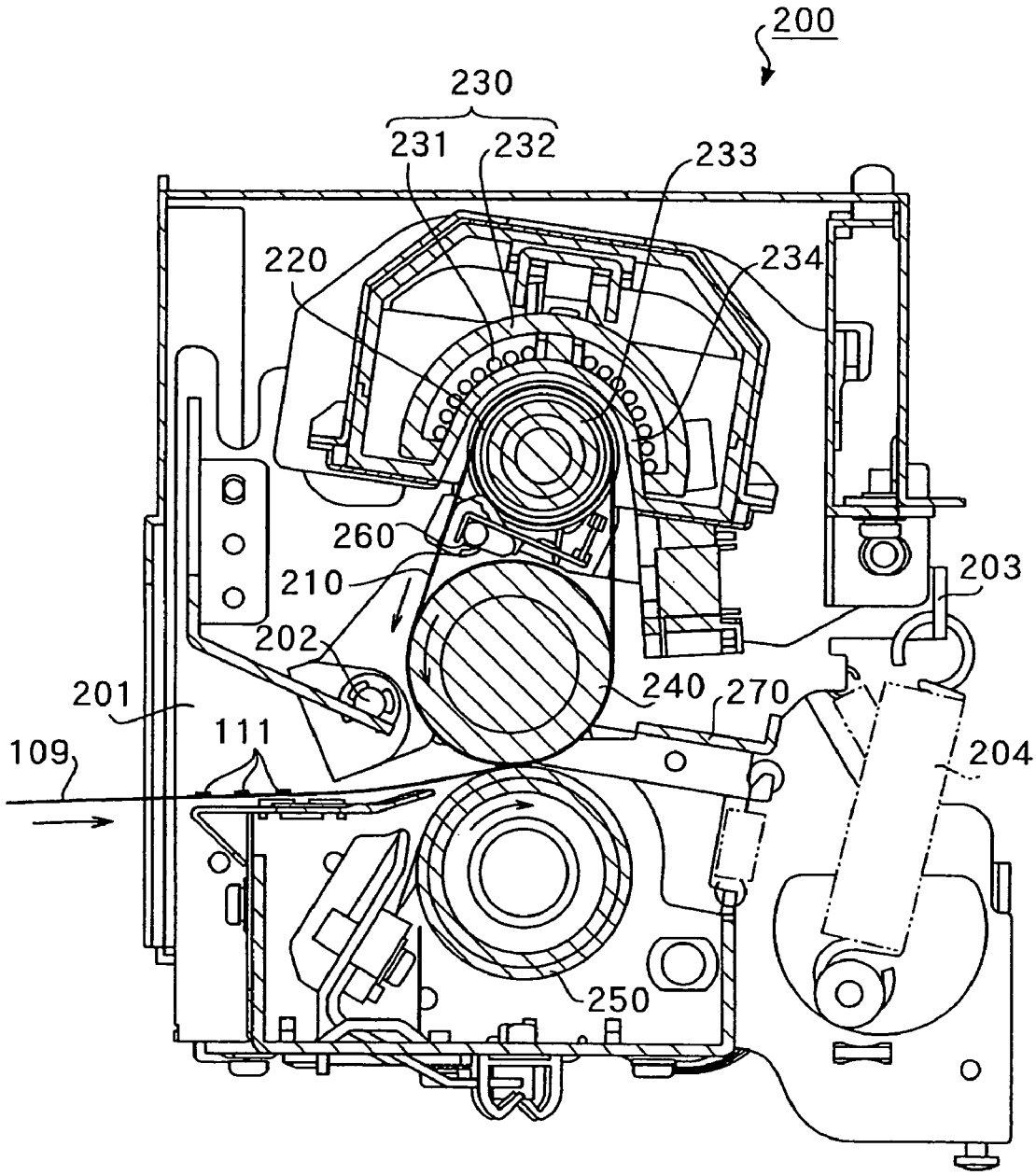
FIG. 4 is a cross-sectional view showing the basic configuration of a fixing apparatus according to Embodiment 1 of the present invention.

A fixing apparatus according to Embodiment 1 will now be described in greater detail by giving a specific example. FIG. 4 is a cross-sectional view showing the basic configuration of a fixing apparatus according to Embodiment 1. As shown in FIG. 4, fixing apparatus 200 includes a fixing belt 210, a supporting roller 220 serving as a belt supporting member, an excitation apparatus 230 serving as an induction heating mechanism, a fixing roller 240, a pressure roller 250 serving as a belt rotation mechanism, and so forth.

In FIG. 4, fixing belt 210 is suspended between supporting roller 220 and fixing roller 240. Supporting roller 220 is rotatably pivoted in the upper part of body side plate 201 of fixing apparatus 200. Fixing roller 240 is rotatably pivoted in a rocking plate 203 attached in a freely rocking fashion to body side plate 201 by means of a short shaft 202. Pressure roller 250 is rotatably pivoted in the lower part of body side plate 201 of fixing apparatus 200.

Rocking plate 203 rocks in a clockwise direction about short shaft 202 through the contracting action of a coil spring 204. Fixing roller 240 is displaced in line with this rocking of rocking plate 203, and, by this displacement, is pressed against pressure roller 250 with fixing belt 210 inbetween. Supporting roller 220 is urged in the opposite direction to fixing roller 240 by a spring (not shown), by which means predetermined tension is applied to fixing belt 210.

Pressure roller 250 is rotated in the direction indicated by the arrow by a driving source (not shown). Fixing roller 240 is rotated driven by the rotation of pressure roller 250 while gripping fixing belt 210. By this means, fixing belt 210 is rotated in the direction indicated by the arrow, gripped between fixing roller 240 and pressure roller 250. By means of this gripping and rotation of fixing belt 210, a nip area for heat-fixing unfixed toner image 111 onto recording paper 109 is formed between fixing belt 210 and pressure roller 250.

Excitation apparatus 230 comprises the above-described IH type induction heating mechanism, and as shown in FIG. 4, has an exciting coil 231 serving as a magnetism generation section installed along the outer peripheral surface of the part of fixing belt 210 suspended on supporting roller 220, and a core 232 composed of ferrite covering exciting coil 231. Exciting coil 231 extends in the paper passage width direction and is wound so as to loop back following the direction of movement of fixing belt 210. Inside supporting roller 220 is provided an opposed core 233 that is opposite exciting coil 231 with fixing belt 210 and supporting roller 220 inbetween.

Exciting coil 231 is formed using litz wire comprising bundled thin wires, and the cross-sectional shape is formed as a semicircle so as to cover the outer peripheral surface of fixing belt 210 suspended on supporting roller 220. An excitation current with a drive frequency of 25 kHz is applied to exciting coil 231 from an exciting circuit (not shown). By this means, an alternating field is generated between core 232 and opposed core 233, an eddy current is generated in the conductive layer of fixing belt 210, and fixing belt 210 produces heat. In this example, the configuration is such that fixing belt 210 produces heat, but a configuration may also be used whereby supporting roller 220 is made to produce heat, and heat from supporting roller 220 is transferred to fixing belt 210.

Core 232 is attached to the center and part of the rear of exciting coil 231. As an alternative to ferrite, a high-permeability material such as permalloy can also be used as the material of core 232 and opposed core 233.

In fixing apparatus 200, as shown in FIG. 4, unfixed toner image 111 can be heat-fixed onto recording paper 109 by transporting recording paper 109 to which unfixed toner image 111 has been transferred from the direction indicated by the arrow so that the surface bearing unfixed toner image 111 is brought into contact with fixing belt 210.

A temperature sensor 260 comprising a thermistor is positioned at the part of the rear surface of fixing belt 210 that has passed the area of contact with supporting roller 220. The temperature of fixing belt 210 is detected by this temperature sensor 260. The output of temperature sensor 260 is provided to a control apparatus (not shown). Based on the output of temperature sensor 260, this control apparatus controls the power supplied to exciting coil 231 via the aforementioned exciting circuit so that an optimal image fixing temperature is attained, and by this means the calorific value of fixing belt 210 is controlled.

Downstream in the recording paper 109 transportation direction, an paper ejection guide 270 that guides recording paper 109 toward output tray 116 after heat-fixing is finished is provided in the area where fixing belt 210 is suspended on fixing roller 240.

A coil guide 234 serving as a supporting member is also provided in excitation apparatus 230, integral with exciting coil 231 and core 232. This coil guide 234 is formed of a resin with a high heat-resistance temperature such as a PEEK material or PPS. The provision of coil guide 234 makes it possible to confine heat emitted from fixing belt 210 in the space between fixing belt 210 and exciting coil 231, and prevent damage to exciting coil 231.

Although core 232 shown in FIG. 4 has a semicircular cross-section, core 232 need not necessarily have a shape that follows the shape of exciting coil 231, and may, for example, have an approximately n-shaped cross-section.

Fixing belt 210 comprises, for example, a thin endless belt with a diameter of 50 mm and thickness of 50 μm, with a conductive layer formed by dispersing silver powder in base material of polyimide resin with a glass transition point of 360 (□). The conductive layer may be composed of 2 or 3 laminated silver layers with a thickness of 10 μm. The surface of this fixing belt 210 may be coated with a 5 μm thick release layer of fluororesin (not shown) to provide releasability. It is desirable for the glass transition point of the material of fixing belt 210 to be in a range from 200 (□) to 500 (□) Resin or rubber with good releasability such as PTFE, PFA, FEP, silicone rubber, fluororubber, or the like, may be used, alone or mixed, for the release layer on the surface of fixing belt 210.

As an alternative to the above-mentioned polyimide resin, a heat-resistant resin such as fluororesin or metal such as an electroformed thin nickel sheet or thin stainless sheet can also be used as the base material of fixing belt 210. For example, fixing belt 210 may be configured by executing 10 μm thick copper plating on a 40 μm thick SUS430 (magnetic) or SUS304 (nonmagnetic) surface.

For performing heating control of fixing belt 210 in paper passage width direction (supporting roller 220 lengthwise direction) described later herein, it is desirable for at least 50% of magnetic flux to pass through fixing belt 210. It is therefore desirable for fixing belt 210 to be formed using a nonmagnetic material such as silver or copper. If fixing belt 210 is formed using a magnetic material, it should be made as thin as possible (preferably not more than 50 μm thick). For example, if a 40 μm thick nickel belt is used, when excitation apparatus 230 drive frequency f=25 kHz, a thickness of 40 μm is approximately half the skin depth of nickel (Ni), and approximately 60% of magnetic flux passes through fixing belt 210, facilitating heating control of fixing belt 210 in the paper passage width direction.

When fixing belt 210 is used as an image heating element for heat-fixing of monochrome images, it is sufficient to secure releasability, but when fixing belt 210 is used as an image heating element for heat-fixing of color images, it is desirable for elasticity to be provided by forming a thick rubber layer. The thermal capacity of fixing belt 210 should preferably be 60 J/K or less, and still more preferably 40 J/K or less.

Supporting roller 220 is a cylindrical metal roller 20 mm in diameter, 320 mm in length, and 0.2 mm thick. If the material of supporting roller 220 is as thin as 0.04 mm or so, a magnetic material such as iron or nickel may be used, although a nonmagnetic material that allows easy passage of magnetic flux is preferable. The material should be as insusceptible to the generation of eddy currents as possible, and use of a nonmagnetic stainless material with a specific resistance of 50 μΩcm or higher is desirable. A supporting roller 220 of the nonmagnetic stainless material SUS304 has a high specific resistance of 72 μΩcm as well as being nonmagnetic, and therefore magnetic flux that passes through supporting roller 220 is not greatly masked, and with 0.2 mm thick material, for example, the heat production of supporting roller 220 is extremely small. Also, a supporting roller 220 of SUS304 has good mechanical strength, enabling the thermal capacity to be further decreased by reducing the thickness to 0.04 mm, and is suitable for use in fixing apparatus 200 with this configuration. Supporting roller 220 should preferably have a relative permeability of 4 or less, and be from 0.04 mm to 0.2 mm in thickness.

Fixing roller 240 is 30 mm in diameter and made of silicone rubber, an elastic foam material with low surface hardness (here, JISA 30 degrees) and low thermal conductivity.

Pressure roller 250 is made of silicone rubber with a hardness of JISA 65 degrees. A heat-resistant resin or other rubber such as fluororubber or fluororesin may also be used as the material of pressure roller 250. It is also desirable for the surface of pressure roller 250 to be coated with resin or rubber such as PFA, PTFE, or FEP, alone or mixed, to increase wear resistance and releasability. Furthermore, it is desirable for pressure roller 250 to be made of a material with low thermal conductivity.

As stated earlier, a problem with a conventional fixing apparatus of this kind is that, since the magnetic gap between a paper passage area and paper non-passage area of the fixing belt is fixed, diverted flow of magnetic flux occurs from the edge of a paper passage area to a paper non-passage area, heat accumulates at the boundary between a paper passage area and paper non-passage area of the fixing belt, a phenomenon of an excessive rise in temperature occurs at this boundary area, and the body of the fixing apparatus is made larger. Also, with a conventional fixing apparatus, the paper passage area width of the fixing roller can only be made to provide for two recording material paper widths—maximum size and small size. In addition, there is a problem of heat production by the magnetic flux masking shield that masks magnetic flux in a paper non-passage area.

Figure 5:
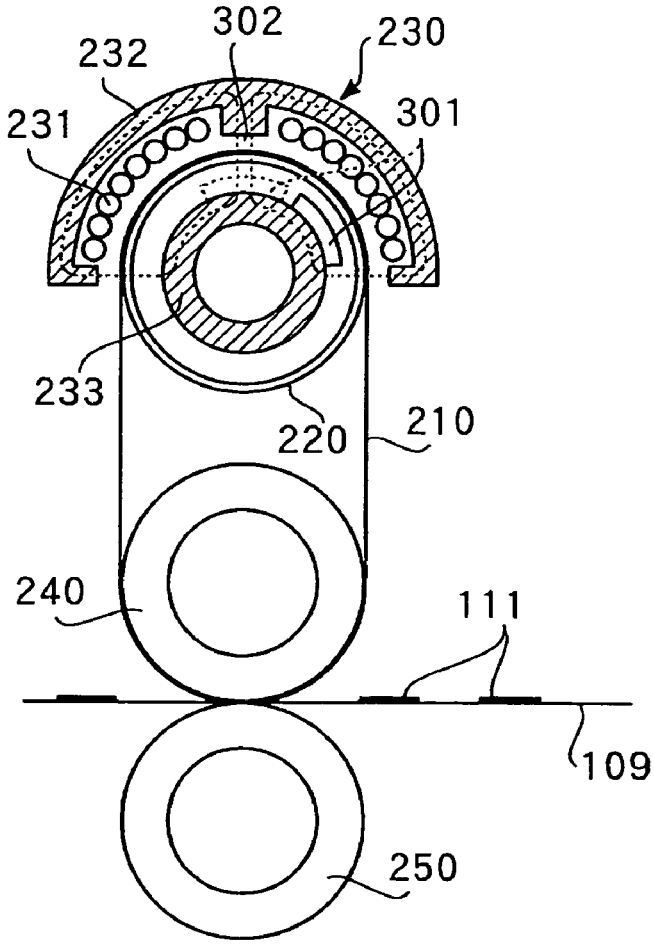
FIG. 5 is a schematic cross-sectional view showing the configuration of the principal parts of a fixing apparatus according to Embodiment 1 of the present invention.

Thus, as shown in FIG. 5, fixing apparatus 200 according to Embodiment 1 has magnetism masking elements 301 of a material that can mask magnetism. Magnetism masking elements 301 are located between excitation apparatus 230 and opposed core 233, and are supported so as to be free to move relative to excitation apparatus 230 in the direction of movement of fixing belt 210 serving as a heat-producing element that allows passage of magnetic flux.

Figure 6:
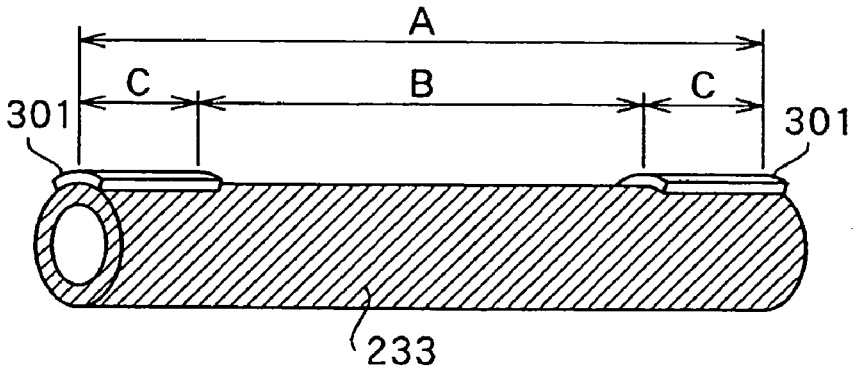
FIG. 6 is a schematic oblique drawing showing a configuration in which magnetism masking elements are provided on an opposed core of a fixing apparatus according to Embodiment 1 of the present invention.

In fixing apparatus 200 according to Embodiment 1, magnetism masking elements 301 are configured so as to be displaced relative to excitation apparatus 230. A tubular sleeve (not shown) mated with opposed core 233, for example, can be used as a supporting member for magnetism masking elements 301. In fixing apparatus 200 according to Embodiment 1, opposed core 233 is used as a supporting member for magnetism masking elements 301, as shown in FIG. 6.

The positions of magnetism masking elements 301 on opposed core 233 are decided in accordance with the paper passage reference of recording paper 109. Here, the paper passage reference of recording paper 109 is assumed to be the center reference, and magnetism masking elements 301 are provided at both ends of opposed core 233, as shown in FIG. 6. If the maximum paper passage area width of fixing belt 210 corresponding to maximum-size recording paper is designated A, and the small-size paper passage area width of fixing belt 210 corresponding to small-size recording paper is designated B, as shown in FIG. 6, magnetism masking elements 301 have a length C corresponding to the paper non-passage area at either side of fixing belt 210 when small-size recording paper is passed through.

In fixing apparatus 200 according to Embodiment 1, supporting roller 220 comprises a member that does not mask, but allows passage of, magnetic flux generated by excitation apparatus 230, such as the above-described nonmagnetic stainless material (SUS304) with a specific resistance of 72 μΩcm, for example.

In FIG. 5, magnetism masking elements 301 are displaced to a magnetic path blocking position (the position shown by a dashed line in FIG. 5) in which they block a magnetic path 302 corresponding to a paper non-passage area of fixing belt 210 between excitation apparatus 230 and opposed core 233, and a magnetic path clearing position (the position shown by a solid line in FIG. 5) in which they clear magnetic path 302.

Figure 7:
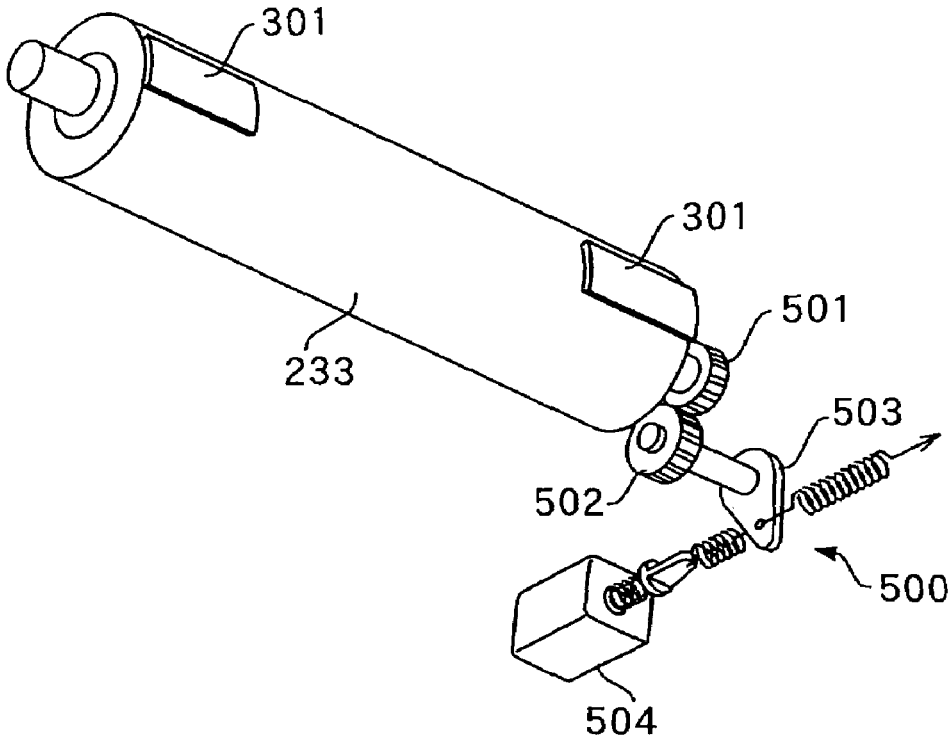
FIG. 7 is a schematic oblique drawing showing the configuration of a displacement mechanism that displaces magnetism masking elements of a fixing apparatus according to Embodiment 1 of the present invention.

FIG. 7 is a schematic oblique drawing showing a displacement mechanism 500 that rotates opposed core 233 constituting the supporting member of magnetism masking elements 301 and displaces magnetism masking elements 301. As shown in FIG. 7, this displacement mechanism 500 is composed of a small gear wheel 501 attached to the spindle of opposed core 233, a large gear wheel 502 that meshes with small gear wheel 501, an arm 503 integral with the spindle of large gear wheel 502, a solenoid 504 that causes arm 503 to swing, and so forth.

Figure 8:
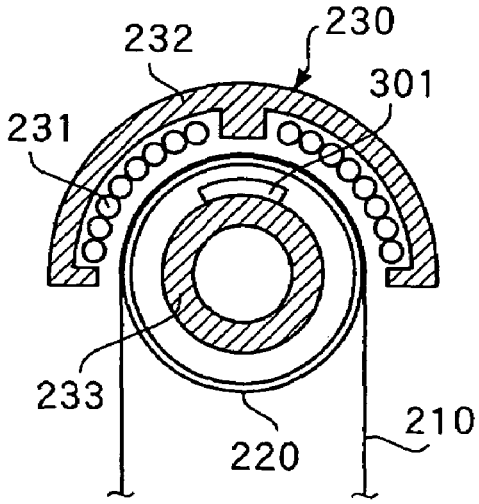
FIG. 8 is a schematic cross-sectional view showing a state in which magnetism masking elements of a fixing apparatus according to Embodiment 1 of the present invention have been displaced to the magnetic path blocking position.

In FIG. 7, when solenoid 504 is turned on (energized), the actuator of solenoid 504 moves and arm 503 swings. Through this swinging of arm 503, large gear wheel 502 rotates, and small gear wheel 501 rotates driven by the rotation of large gear wheel 502. Through this driven rotation of small gear wheel 501, the spindle of opposed core 233 rotates, and magnetism masking elements 301 are displaced from the above-described magnetic path clearing position to the above-described magnetic path blocking position shown in FIG. 8. By this means, magnetic paths 302 corresponding to paper non-passage areas of fixing belt 210 between excitation apparatus 230 and opposed core 233 are blocked by magnetism masking elements 301.

On the other hand, when solenoid 504 in the above-described on state is turned off (de-energized), arm 503 returns to its initial position shown in FIG. 7, the spindles of large gear wheel 502, small gear wheel 501, and opposed core 233 are all rotated backward, and magnetism masking elements 301 are returned from the above-described magnetic path blocking position to the above-described magnetic path clearing position.

Thus, in fixing apparatus 200 according to Embodiment 1, by turning solenoid 504 of displacement mechanism 500 on and off, magnetic paths 302 corresponding to paper non-passage areas of fixing belt 210 between excitation apparatus 230 and opposed core 233 are blocked or cleared by magnetism masking elements 301, and the strength of magnetic coupling in the paper passage width direction between fixing belt 210 and exciting coil 231 is controlled.

That is to say, when the size of recording paper 109 passed through is the maximum size, solenoid 504 is left in the off state in FIG. 7, and magnetism masking elements 301 are kept on standby in the above-described magnetic path clearing position. As a result, as shown in FIG. 5, magnetic flux generated by excitation apparatus 230 flows along the entire lengthwise of opposed core 233 and acts on the whole of maximum paper passage area width A of fixing belt 210, and heat production distribution in the paper passage width direction of fixing belt 210 is kept uniform over the whole of maximum paper passage area width A.

On the other hand, when the size of recording paper 109 passed through is a small size, solenoid 504 is turned on in FIG. 7, and magnetism masking elements 301 are displaced to the magnetic path blocking position in which they block magnetic paths 302 corresponding to paper non-passage areas of fixing belt 210 between excitation apparatus 230 and opposed core 233. As a result, magnetic coupling with exciting coil 231 in paper non-passage areas of fixing belt 210 decreases, magnetic flux generated by excitation apparatus 230 passes through only small-size paper passage area width B of opposed core 233 shown in FIG. 6, heat production of paper non-passage areas of fixing belt 210 is suppressed, and an excessive rise in temperature of these paper non-passage areas can be prevented.

In fixing apparatus 200 according to Embodiment 1, fixing belt 210 and magnetism masking elements 301 are composed of a nonmagnetic electrical conductor such as silver, copper, or aluminum. As fixing belt 210 is composed of a thin nonmagnetic electrical conductor, its electrical resistance is high and it produces heat. Also since fixing belt 210 uses a nonmagnetic material, magnetic flux easily passes through fixing belt 210. It is thus possible to provide magnetism masking elements 301 on the opposite side of fixing belt 210 from excitation apparatus 230. That is to say, the necessity of making the magnetism masking elements thin can be eliminated, and their thickness can be increased to around 1 mm, for example. As a result, the electrical resistance of magnetism masking elements 301 becomes low, enabling heat production by magnetism masking elements 301 to be suppressed. Also, as magnetism masking elements 301 are provided on opposed core 233 composed of a material with high thermal conductivity and specific heat such as ferrite, heat generated by magnetism masking elements 301 is conducted and dispersed in opposed core 233, and an excessive rise in temperature of magnetism masking elements 301 is suppressed. Furthermore, increasing the thickness of magnetism masking elements 301 reduces their electrical resistance, making it easier for an eddy current to flow. As a result, a repulsive field is strengthened, and magnetic flux can be more effectively masked. Also, since magnetism masking elements 301 do not require through-holes 35, they can mask magnetic flux more effectively than magnetic flux masking shield 31 in FIG. 1.

As described above, in fixing apparatus 200 according to Embodiment 1, magnetic paths 302 between excitation apparatus 230 and opposed core 233 are masked by magnetism masking elements 301, enabling magnetic flux of paper non-passage areas that induction-heats fixing belt 210 to be effectively masked, and diverted flow of magnetic flux corresponding to a paper passage area of fixing belt 210 to paper non-passage areas to be prevented.

Thus, with fixing apparatus 200 according to Embodiment 1, magnetic flux corresponding to paper non-passage areas of fixing belt 210 can be effectively blocked by magnetism masking elements 301, enabling an excessive rise in temperature due to accumulation of heat in paper non-passage areas of fixing belt 210 to be prevented.

Also, in fixing apparatus 200 according to Embodiment 1, since magnetic paths 302 are blocked or cleared by relative displacement of excitation apparatus 230 and magnetism masking elements 301, the body of the apparatus need not be made large in the fixing belt 210 paper passage area width direction.

Furthermore, in fixing apparatus 200 according to Embodiment 1, it is possible to block magnetic flux corresponding to paper non-passage areas of fixing belt 210 by blocking only magnetic paths 302 between excitation apparatus 230 and opposed core 233 by means of magnetism masking elements 301, enabling magnetism masking elements 301 to be configured compactly, and making it possible for at least two magnetism masking elements 301 to be provided. Therefore, in this fixing apparatus 200, it is possible to make the paper passage area width of fixing belt 210 accommodate at least three areas by providing magnetism masking elements 301 having different lengths in the paper passage area width direction.

Moreover, in fixing apparatus 200 according to Embodiment 1, excitation apparatus 230 that heats fixing belt 210 directly is provided around the outer peripheral surface of the part of fixing belt 210 that is suspended on supporting roller 220. Therefore, in this fixing apparatus 200, the permeability of supporting roller 220 itself is improved, and supporting roller 220 does not become overheated even during continuous fixing, as a result of which the temperature difference between the temperature of the paper passage area and the temperature of paper non-passage areas of fixing belt 210 due to thermal conduction from supporting roller 220 is within a permissible range, and the occurrence of temperature unevenness in the paper passage width direction of fixing belt 210 can be suppressed.

Also, as supporting roller 220 of fixing apparatus 200 according to Embodiment 1 is a metal roller with a thickness of 0.04 mm to 0.2 mm, its thermal capacity is extremely small. Therefore, in this fixing apparatus 200, a large amount of heat is no longer lost from fixing belt 210 due to contact with supporting roller 220 during warming-up, and the startup time can be greatly shortened.

Furthermore, as supporting roller 220 of fixing apparatus 200 according to Embodiment 1 has a specific resistance of 50 μΩcm or higher, it is not susceptible to the flow of eddy currents, heat production by supporting roller 220 itself is virtually eliminated, and input power can be effectively and efficiently used only for heat production of fixing belt 210.

If a nonmagnetic stainless material (SUS304) with a specific resistance of 72 μΩcm is used for supporting roller 220, magnetic flux passes through supporting roller 220 without being masked, and heat production is extremely small even with 0.2 mm thick material. Also, this supporting roller 220 has good mechanical strength and enables the strength necessary for suspending fixing belt 210 to be secured, allowing the thermal capacity to be further decreased by reducing the thickness, and enabling the startup time to be further shortened during warming up.

When a supporting roller 220 of a nonmagnetic material with low specific resistance (such as aluminum or copper) is used, a large quantity of eddy currents are generated by magnetic flux passing therethrough, and repulsive fields are formed, with the result that magnetic flux crossing fixing belt 210 decreases and heat production efficiency falls. With a supporting roller 220 of a magnetic material with low specific resistance such as iron (Fe) or nickel (Ni), cross flux from fixing belt 210 can be secured but supporting roller 220 produces heat itself due to generated eddy currents, making startup slower.

Incidentally, the specific resistances (in μΩcm units) are as follows: 9.8 for iron, 2.65 for aluminum, 1.7 for copper, 6.8 for nickel, 60 for magnetic stainless (SUS430), and 72 for nonmagnetic stainless (SUS304).

Embodiment 2

Figure 9:
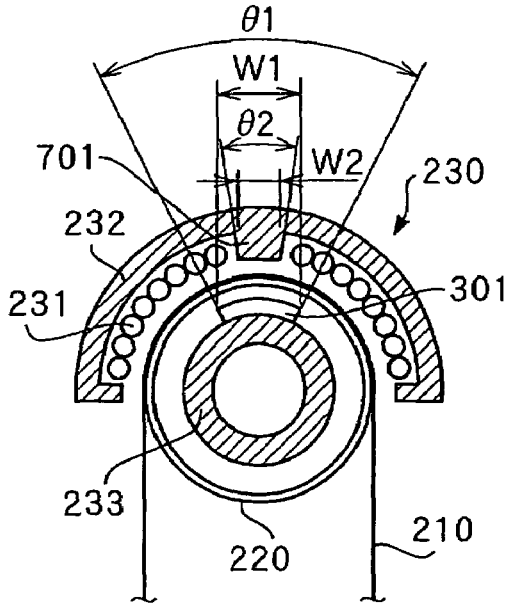
FIG. 9 is a schematic cross-sectional view showing the configuration of the principal parts of a fixing apparatus according to Embodiment 2 of the present invention.

Next, a fixing apparatus according to Embodiment 2 will be described. In this fixing apparatus, as shown in FIG. 9, core 232 of excitation apparatus 230 has a center core 701 located in the center of the windings of exciting coil 231. This fixing apparatus is configured so that width W1 of magnetism masking elements 301 in the direction of movement relative to excitation apparatus 230 is greater than width W2 of center core 701 in the same direction. As shown in FIG. 9, width W1 of magnetism masking elements 301 and width W2 of center core 701 can be stipulated by angle θ1 and angle θ2.

By this means, with this fixing apparatus, in addition to the effects of the fixing apparatus of Embodiment 1, magnetic flux passing through paper non-passage areas of fixing belt 210 can be masked more effectively, and an excessive rise in temperature due to accumulation of heat in paper non-passage areas of fixing belt 210 can be surely prevented.

Embodiment 3

Figure 10:
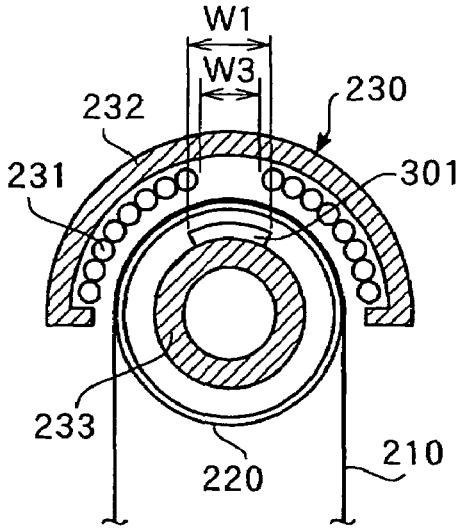
FIG. 10 is a schematic cross-sectional view showing the configuration of the principal parts of a fixing apparatus according to Embodiment 3 of the present invention.

Next, a fixing apparatus according to Embodiment 3 will be described. In this fixing apparatus, as shown in FIG. 10, core 232 of excitation apparatus 230 has a shape with no center core. This fixing apparatus is configured so that width W1 of magnetism masking elements 301 in the direction of movement relative to excitation apparatus 230 is greater than width W3 in the same direction of the center of the windings of exciting coil 231 of excitation apparatus 230. Width W1 of magnetism masking elements 301 and width W3 of the center of the windings of exciting coil 231 can be stipulated by angles.

By this means, with this fixing apparatus, as with a fixing apparatus according to Embodiment 2, magnetic flux passing through paper non-passage areas of fixing belt 210 can be masked more effectively, and an excessive rise in temperature due to accumulation of heat in paper non-passage areas of fixing belt 210 can be surely prevented.

Embodiment 4

Figure 11:
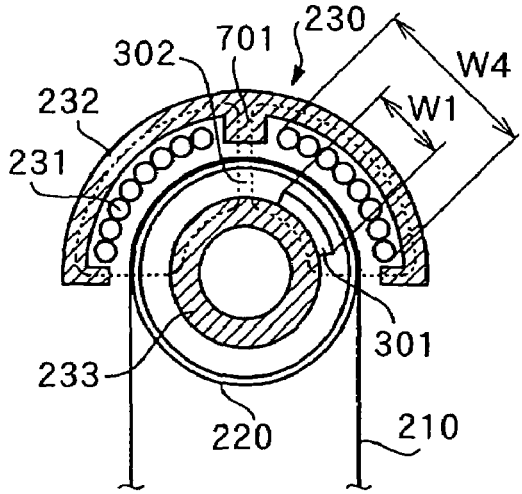
FIG. 11 is a schematic cross-sectional view showing the configuration of the principal parts of a fixing apparatus according to Embodiment 4 of the present invention.

Next, a fixing apparatus according to Embodiment 4 will be described. As shown in FIG. 11, this fixing apparatus is configured so that width W1 of magnetism masking elements 301 in the direction of movement relative to excitation apparatus 230 is greater than winding width W4 in the same direction of a winding section of exciting coil 231.

By this means, with this fixing apparatus, in addition to realization of the effects of a fixing apparatus according to Embodiment 2 or a fixing apparatus according to Embodiment 3, as shown in FIG. 11, magnetism masking elements 301 do not affect magnetic flux flowing in a magnetic path 302 formed by excitation apparatus 230 and opposed core 233 even when the above-described magnetic path clearing position of magnetism masking elements 301 is located opposite a winding section of exciting coil 231.

That is to say, with this fixing apparatus, even if fixing belt 210 is made to produce heat with magnetism masking elements 301 withdrawn to a position opposite a winding section of exciting coil 231, temperature unevenness does not occur in the paper passage area of fixing belt 210. Therefore, in this fixing apparatus, more withdrawal positions of magnetism masking elements 301 can be secured, and it is possible to increase freedom of design when providing numerous magnetism masking elements 301.

In all of the above-described fixing apparatuses according to Embodiment 1 through Embodiment 4, a magnetic path blocking position at which magnetic paths 302 of paper non-passage areas of fixing belt 210 are blocked by magnetism masking elements 301 is assumed to be a position at which magnetism masking elements 301 are opposite the center of the windings of exciting coil 231. This position opposite the center of the windings of exciting coil 231 is the area in which magnetic flux between exciting coil 231 and opposed core 233 is most concentrated.

In the above-described fixing apparatuses according to Embodiment 1 through Embodiment 4, since a position opposite the center of the windings of exciting coil 231 where magnetic flux is most concentrated is used as the magnetic path blocking position of magnetism masking elements 301, as stated above, an excessive rise in temperature of paper non-passage areas of fixing belt 210 can be effectively prevented.

Embodiment 5

Next, a fixing apparatus according to Embodiment 5 will be described. With this fixing apparatus, when a plurality of magnetism masking elements 301*a*, 301*b*, and 301*c* are provided as shown in FIG. 12, for example, at least one magnetic path clearing position of these magnetism masking elements is made a position at which magnetism masking elements 301 are opposite a winding section of exciting coil 231.

Figure 12:
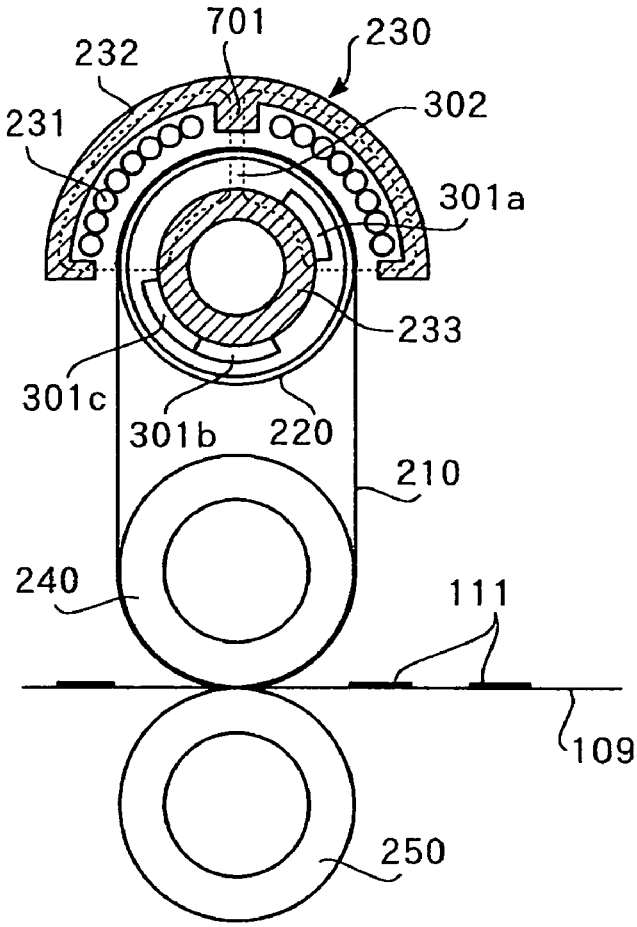
FIG. 12 is a schematic cross-sectional view showing the configuration of a fixing apparatus according to Embodiment 5 of the present invention.

With this fixing apparatus, when magnetism masking elements 301*a* in FIG. 12 are in the above-described magnetic path clearing position, magnetic flux flowing in a magnetic path 302 formed by excitation apparatus 230 and opposed core 233 is not affected by magnetism masking elements 301*a*, and therefore even if fixing belt 210 is made to produce heat in this state, temperature unevenness does not occur in its paper passage area.

Also, with this fixing apparatus, a location away from a winding section of exciting coil 231 can be made a magnetic path clearing position of other magnetism masking elements 301*b* and 301*c*, facilitating the provision of the plurality of magnetism masking elements 301*a*, 301*b*, and 301*c*.

Embodiment 6

Figure 13:
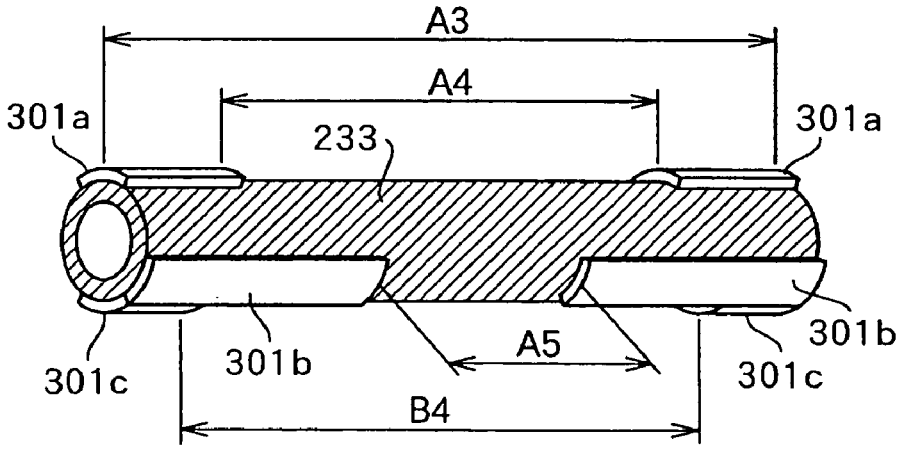
FIG. 13 is a schematic oblique drawing showing a configuration in which magnetism masking elements are provided on an opposed core of a fixing apparatus according to Embodiment 6 of the present invention.

Next, a fixing apparatus according to Embodiment 6 will be described. In this fixing apparatus, a plurality of magnetism masking elements 301*a*, 301*b*, and 301*c* are provided for fixing belt 210 as shown in FIG. 13. These magnetism masking elements 301*a*, 301*b*, and 301*c* have lengths corresponding respectively to a plurality of paper non-passage areas of fixing belt 210 with mutually different widths.

Figure 14:
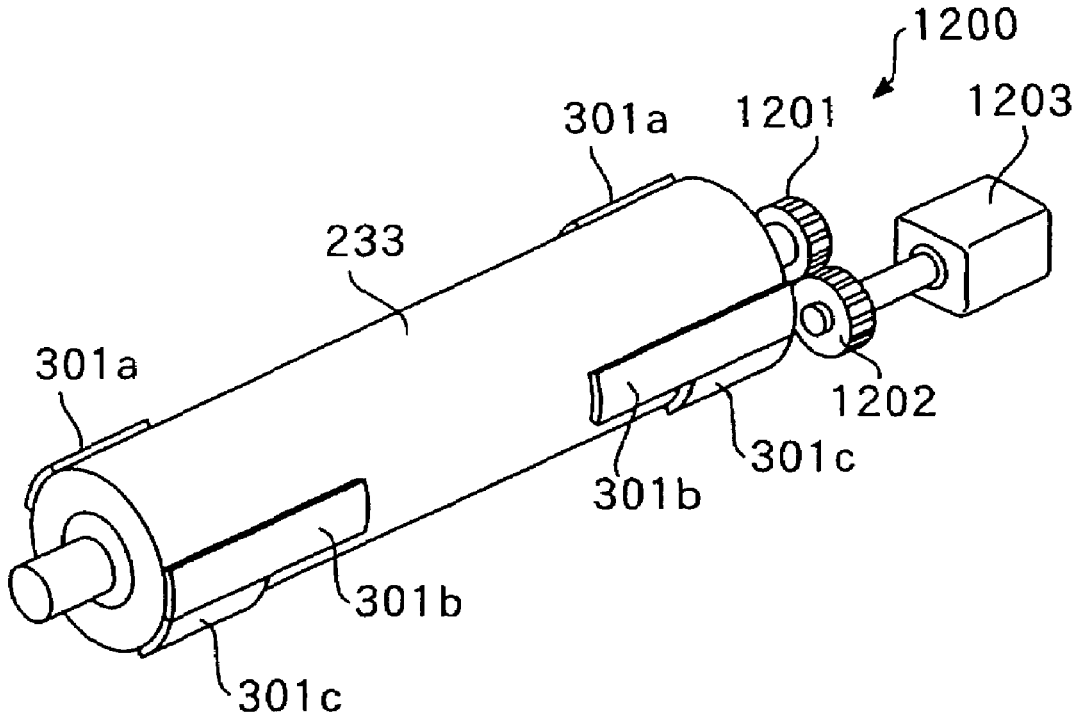
FIG. 14 is a schematic oblique drawing showing the configuration of a displacement mechanism that displaces magnetism masking elements of a fixing apparatus according to Embodiment 6 of the present invention.

FIG. 14 is a schematic oblique drawing showing a displacement mechanism 1200 that rotates opposed core 233 bearing the plurality of magnetism masking elements 301*a*, 301*b*, and 301*c* and displaces the plurality of magnetism masking elements 301*a*, 301*b*, and 301*c*. As shown in FIG. 14, this displacement mechanism 1200 is composed of a small gear wheel 1201 attached to the spindle of opposed core 233, a large gear wheel 1202 that meshes with small gear wheel 1201, a stepping motor 1203 that is axially connected to and rotates large gear wheel 1202, and so forth.

Figure 15:
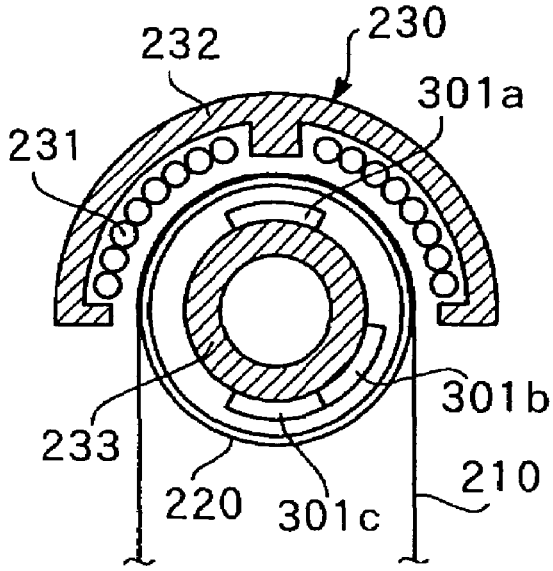
FIG. 15 is a schematic cross-sectional view showing a state in which magnetism masking elements of a fixing apparatus according to Embodiment 6 of the present invention have been displaced to the magnetic path blocking position.

In FIG. 14, when stepping motor 1203 is turned on (energized), large gear wheel 1202 is rotated by the rotation of the spindle of stepping motor 1203, and small gear wheel 1201 rotates driven by the rotation of large gear wheel 1202. Through this driven rotation of small gear wheel 1201, the spindle of opposed core 233 rotate and, of magnetism masking elements 301*a*, 301*b*, and 301*c*, predetermined magnetism masking elements of a length corresponding to the paper non-passage area width of the passed-through recording paper size are displaced from their magnetic path clearing position to their magnetic path blocking position. Here, magnetism masking elements 301*a* are displaced from their magnetic path clearing position to their magnetic path blocking position as shown in FIG. 15. By this means, magnetic paths 302 corresponding to paper non-passage areas of fixing belt 210 between excitation apparatus 230 and opposed core 233 are blocked by magnetism masking elements 301*a*.

On the other hand, when the entire width of the paper passage area of fixing belt 210 is made to produce heat, power to stepping motor 1203 is cut with magnetism masking elements 301*a*, 301*b*, and 301*c* located in their respective above-described magnetic path clearing positions as shown in FIG. 12.

Thus, in this fixing apparatus, by turning stepping motor 1203 of displacement mechanism 1200 on and off, magnetic paths 302 corresponding to paper non-passage areas of fixing belt 210 between excitation apparatus 230 and opposed core 233 are blocked or cleared by magnetism masking elements 301*a*, 301*b*, and 301*c*, and the strength of magnetic coupling in the paper passage width direction between fixing belt 210 and exciting coil 231 is controlled.

Therefore, with this fixing apparatus, by selectively displacing magnetism masking elements 301*a*, 301*b*, and 301*c* from the above-described magnetic path clearing position to the magnetic path blocking position in accordance with the size of recording paper passed through, heat production of paper non-passage areas of fixing belt 210 corresponding to the size of recording paper 109 passed through is suppressed, enabling an excessive rise in temperature of paper non-passage areas of fixing belt 210 to be prevented. Therefore, with this fixing apparatus, it is possible to achieve satisfactory heat-fixing of a plurality of sizes of recording paper 109 by means of fixing belt 210.

Embodiment 7

Next, a fixing apparatus according to Embodiment 7 will be described. In this fixing apparatus, as shown in FIG. 16, a plurality of magnetism masking elements 301*a*, 301*b*, and 301*c* are provided on opposed core 233, which is a rotating element that rotates freely relative to excitation apparatus 230, and the angle forming a normal line passing through the centers of two mutually adjacent magnetism masking elements is set to an angle of either 30 degrees<θ3<60 degrees or 120 degrees<θ4<180 degrees.

Figure 16:
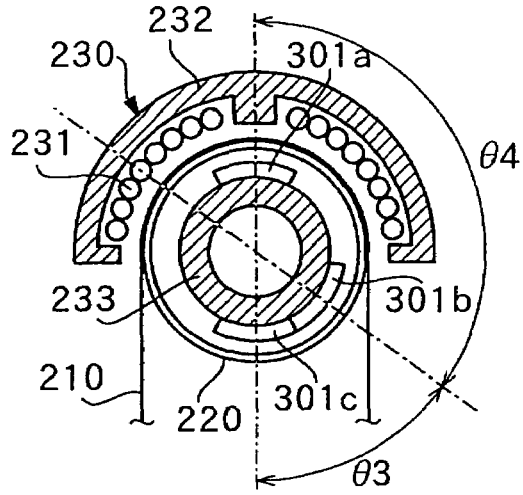
FIG. 16 is a schematic cross-sectional view showing the configuration of the principal parts of a fixing apparatus according to Embodiment 7 of the present invention.

That is to say, in this fixing apparatus, as shown in FIG. 16, aforementioned angle θ3 between a magnetism masking element 301*b* and a magnetism masking element 301*c* is set to 30 degrees<θ3<60 degrees, and aforementioned angle θ4 between a magnetism masking element 301*a* and a magnetism masking element 301*b* is set to 120 degrees<θ4<180 degrees.

In this fixing apparatus, when plurality of magnetism masking elements 301*a*, 301*b*, and 301*c* are located in their respective above-described magnetic path clearing positions, magnetic flux flowing in a magnetic path 302 formed by excitation apparatus 230 and opposed core 233 is not affected by any of plurality of magnetism masking elements 301*a*, 301*b*, and 301*c*, and therefore it is possible to suppress the occurrence of temperature unevenness of a paper passage area when fixing belt 210 is made to produce heat in this state.

Here, it is desirable for above-described magnetism masking elements 301*a*, 301*b*, and 301*c* to be composed of a low-permeability electrical conductor. In a fixing apparatus in which these magnetism masking elements 301*a*, 301*b*, and 301*c* are composed of a low-permeability electrical conductor, magnetism masking elements 301*a*, 301*b*, and 301*c* can be configured as inexpensive members of copper, aluminum, or the like.

Also, as fixing apparatuses according to the above-described embodiments use opposed core 233 as a rotating element that supports magnetism masking elements 301*a*, 301*b*, and 301*c*, the configuration can be simplified.

Embodiment 8

Figure 17:
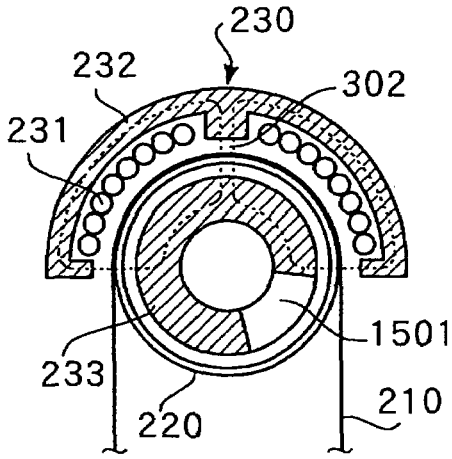
FIG. 17 is a schematic cross-sectional view showing the configuration of the principal parts of a fixing apparatus according to Embodiment 8 of the present invention.
Figure 18:
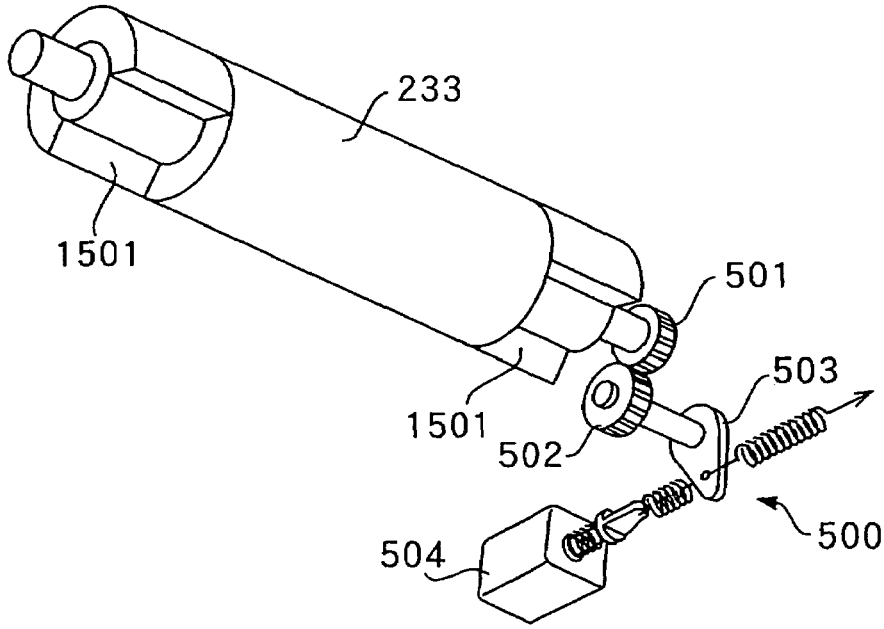
FIG. 18 is a schematic oblique drawing showing the configuration of a displacement mechanism that displaces cutaway parts of an opposed core of a fixing apparatus according to Embodiment 8 of the present invention.

Next, a fixing apparatus according to Embodiment 8 will be described. In this fixing apparatus, as shown in FIG. 17, the aforementioned magnetism masking elements are configured as cutaway parts 1501 provided in opposed core 233. This cutaway parts 1501 of fixing apparatus are displaced to the above-described magnetic path blocking position or magnetic path clearing position by means of displacement mechanism 500 shown in FIG. 18 in accordance with the size of recording paper 109 passed through. The same displacement mechanism 500 as shown in FIG. 7 can be used as this displacement mechanism 500. A configuration is also possible in which cutaway parts functioning as magnetism masking elements are provided in positions corresponding to magnetism masking elements 301*a*, 301*b*, and 301*c* shown in FIG. 16 instead of a single pair of cutaway parts being provided.

In this fixing apparatus, since magnetic flux passes through supporting roller 220, by selectively reversing the position of cutaway parts 1501 provided in opposed core 233 in accordance with the size of recording paper 109, magnetic flux that passes through supporting roller 220 can be absorbed or suppressed, enabling heat production distribution in the paper passage width direction of fixing belt 210 to be controlled easily.

Also, with this fixing apparatus, since cutaway parts 1501 serving as above-described magnetism masking elements need not be provided as separate members, the configuration can be made simpler and less expensive.

Embodiment 9

Figure 19:
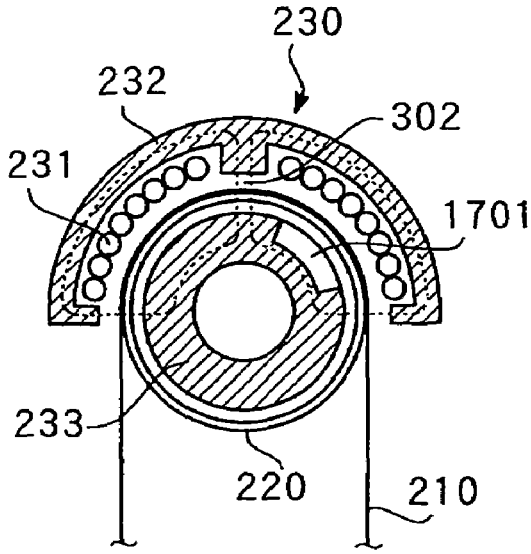
FIG. 19 is a schematic cross-sectional view showing the configuration of the principal parts of a fixing apparatus according to Embodiment 9 of the present invention.

Next, a fixing apparatus according to Embodiment 9 will be described. In this fixing apparatus, as shown in FIG. 19, the aforementioned magnetism masking elements are configured as recesses 1701 provided in opposed core 233. With this fixing apparatus, as with a fixing apparatus according to Embodiment 8, recesses 1701 serving as above-described magnetism masking elements need not be provided as separate members, enabling the configuration to be made simpler and less expensive.

With this fixing apparatus, as shown in FIG. 19, recesses 1701 do not affect magnetic flux flowing in a magnetic path 302 formed by excitation apparatus 230 and opposed core 233 even when the magnetic path clearing position of the magnetism masking elements is made a position opposite a winding section of exciting coil 231. Therefore, with this fixing apparatus, temperature unevenness does not occur in the paper passage area of fixing belt 210 even if fixing belt 210 is made to produce heat with recesses 1701 withdrawn to a position opposite a winding section of exciting coil 231, and therefore more withdrawal positions of recesses 1701 can be secured.

Embodiment 10

Figure 20:
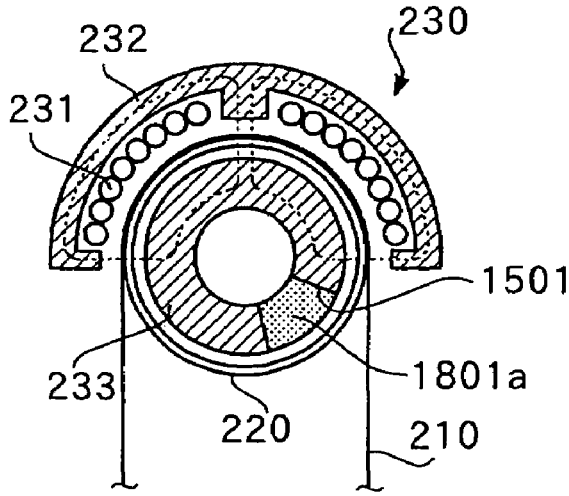
FIG. 20 is a configuration diagram of principal parts in which an electrical conductor is embedded in cutaway parts of an opposed core of a fixing apparatus according to Embodiment 10 of the present invention.
Figure 21:
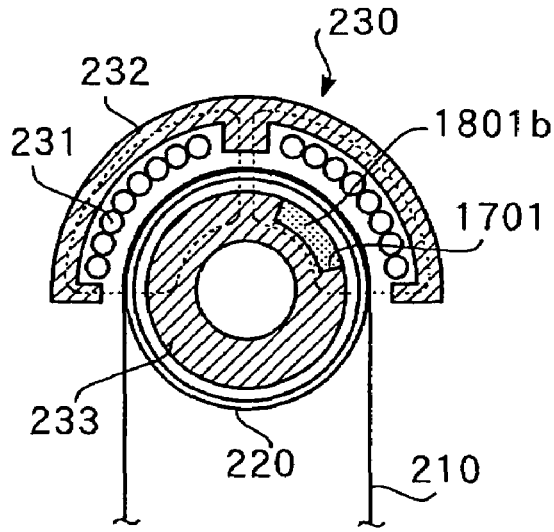
FIG. 21 is a schematic cross-sectional view showing the configuration of principal parts in which an electrical conductor is embedded in recesses of an opposed core of a fixing apparatus.

Next, a fixing apparatus according to Embodiment 10 will be described. As shown in FIG. 20, this fixing apparatus is configured with a low-permeability electrical conductor 1801*a* embedded in above-described cutaway parts 1501. It also has a configuration in which a low-permeability electrical conductor 1801*b* is embedded in above-described recesses 1701 as shown in FIG. 21.

With this fixing apparatus, a decrease in the mechanical strength of opposed core 233 due to the provision of cutaway parts 1501 or recesses 1701 can be prevented. Also, embedding electrical conductor 1801*a* or 1801*b* in the cutaway parts 1501 or recesses 1701, enables equilibrium of the weight balance of opposed core 233 to be achieved.

Here, it is desirable for above-described electrical conductor 1801*a* or 1801*b* to form the same single plane with the surface of opposed core 233. In a fixing apparatus with a configuration in which electrical conductor 1801*a* or 1801*b* is flush with the surface of opposed core 233 in this way, thermal conduction from fixing belt 210 to opposed core 233 and thermal conduction from fixing belt 210 to electrical conductor 1801*a* or 1801*b* are equal, and therefore the occurrence of temperature unevenness of fixing belt 210 can be prevented.

Embodiment 11

Next, a fixing apparatus according to Embodiment 11 will be described. In this fixing apparatus, the above-described three magnetism masking elements 301*a*, 301*b*, and 301*c* have lengths corresponding respectively to A4 size width, A5 size width, and B4 size width paper non-passage areas of fixing belt 210.

Figure 22:
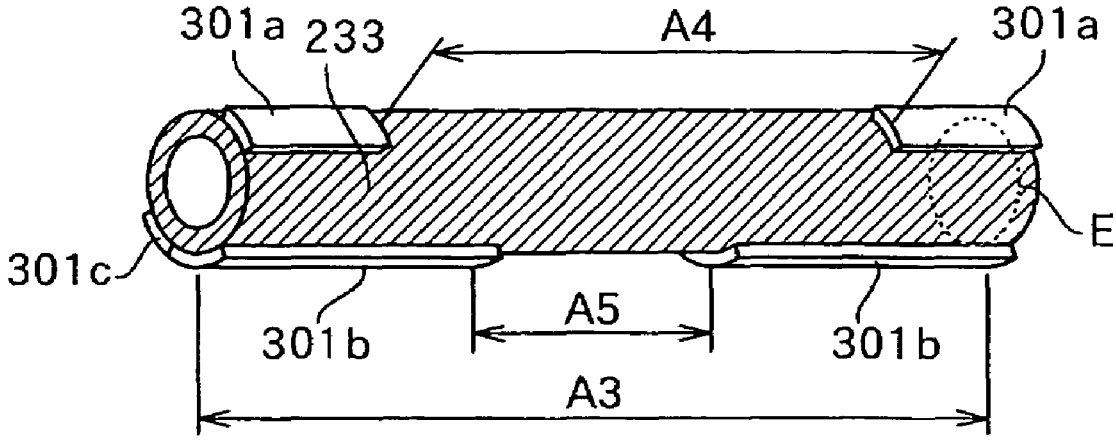
FIG. 22 is a schematic oblique drawing showing magnetism masking elements of an opposed core corresponding to an A3 size recording paper paper-passage mode of a fixing apparatus according to Embodiment 11 of the present invention.
Figure 23:
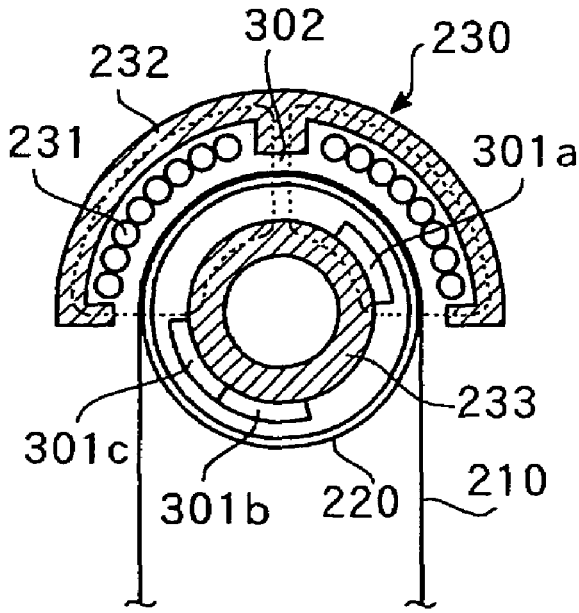
FIG. 23 is a schematic cross-sectional view showing the configuration of the principal parts of a fixing apparatus with the opposed core shown in FIG. 22 cut through plane E.
Figure 24:
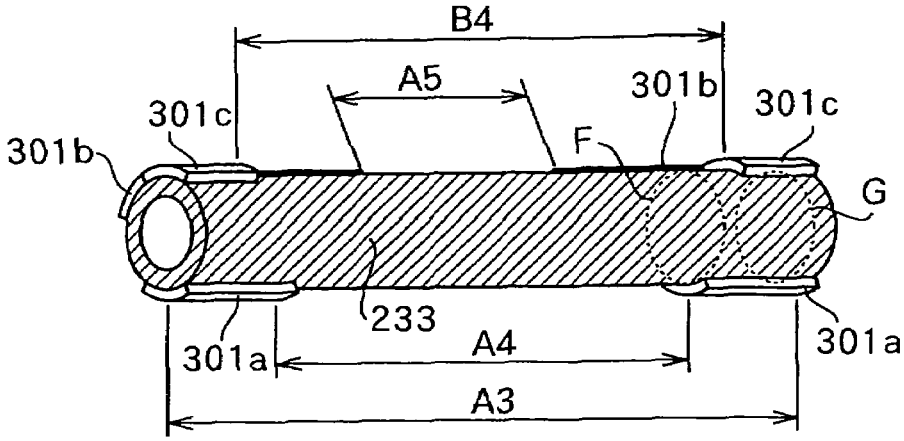
FIG. 24 is a schematic oblique drawing showing magnetism masking elements of an opposed core corresponding to a B4 size recording paper paper-passage mode of a fixing apparatus according to Embodiment 11 of the present invention.
Figure 25A:
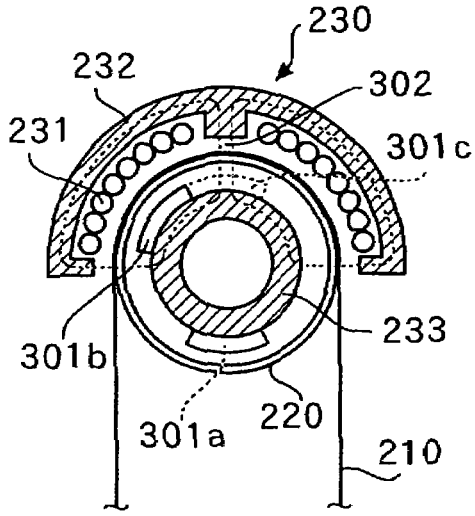
FIG. 25A is a schematic cross-sectional view showing the configuration of the principal parts of a fixing apparatus with the opposed core shown in FIG. 24 cut through plane F.
Figure 25B:
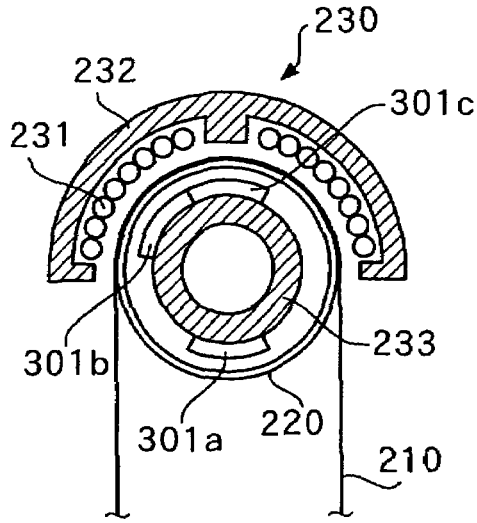
FIG. 25B is a schematic cross-sectional view showing the configuration of the principal parts of a fixing apparatus with the opposed core shown in FIG. 24 cut through plane G.
Figure 26:
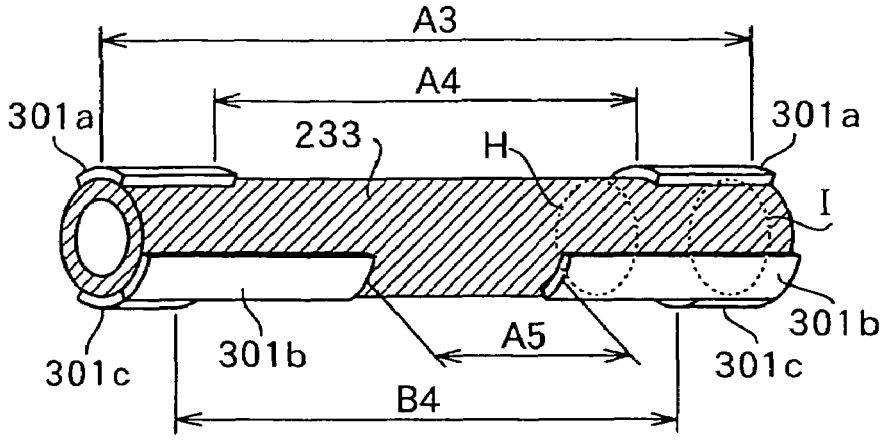
FIG. 26 is a schematic oblique drawing showing magnetism masking elements of an opposed core corresponding to an A4 size recording paper paper-passage mode of a fixing apparatus according to Embodiment 11 of the present invention.
Figure 27A:
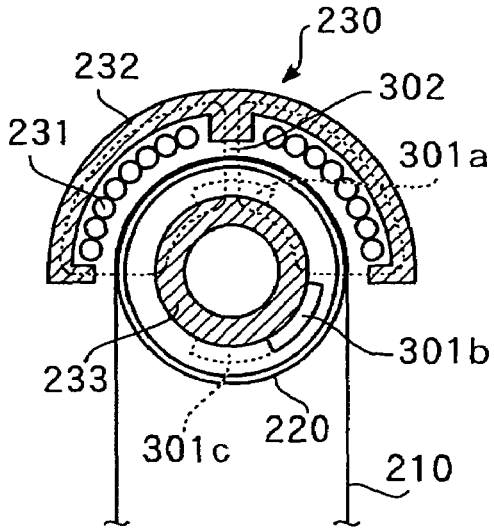
FIG. 27A is a schematic cross-sectional view showing the configuration of the principal parts of a fixing apparatus with the opposed core shown in FIG. 26 cut through plane H.
Figure 27B:
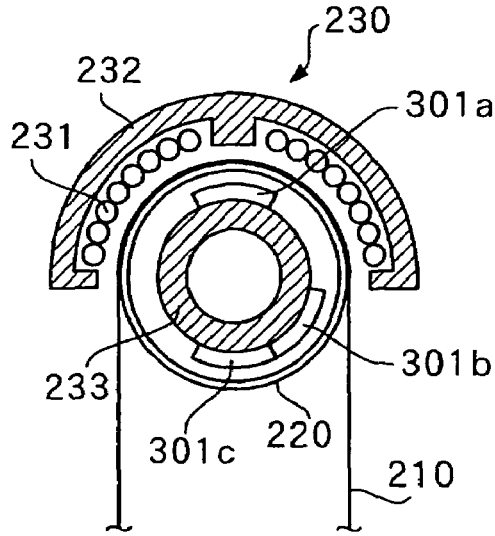
FIG. 27B is a schematic cross-sectional view showing the configuration of the principal parts of a fixing apparatus with the opposed core shown in FIG. 26 cut through plane I.
Figure 28:
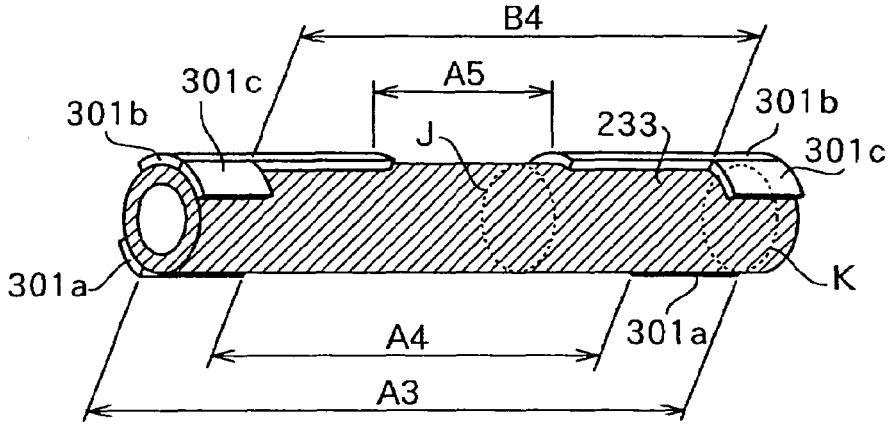
FIG. 28 is a schematic oblique drawing showing magnetism masking elements of an opposed core corresponding to an A5 size recording paper paper-passage mode of a fixing apparatus according to Embodiment 11 of the present invention.
Figure 29A:
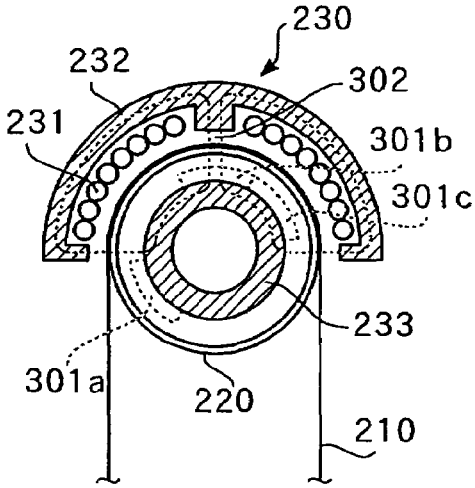
FIG. 29A is a schematic cross-sectional view showing the configuration of the principal parts of a fixing apparatus with the opposed core shown in FIG. 28 cut through plane J.
Figure 29B:
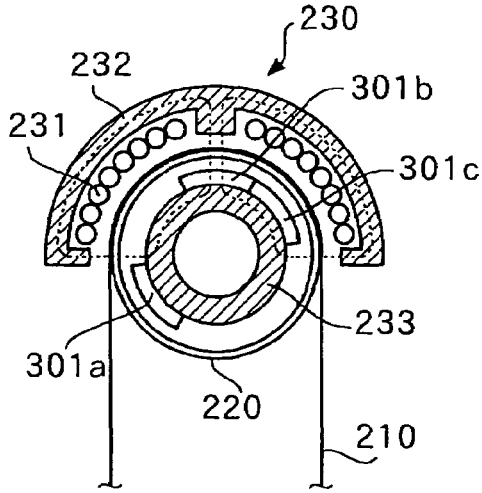
FIG. 29B is a schematic cross-sectional view showing the configuration of the principal parts of a fixing apparatus with the opposed core shown in FIG. 28 cut through plane K.

Therefore, this fixing apparatus can be configured, for example, with the provision of four paper-passage modes: a paper-passage mode of A3 size recording paper 109 as shown in FIGS. 22 and 23, a paper-passage mode of B4 size as shown in FIG. 24 and FIGS. 25A and 25B, a paper-passage mode of A4 size as shown in FIG. 26 and FIGS. 27A and 27B, and a paper-passage mode of A5 size as shown in FIG. 28 and FIGS. 29A and 29B.

That is to say, in a paper-passage mode of A3 size recording paper 109, magnetism masking elements 301*a*, 301*b*, and 301*c* are all withdrawn to the above-described magnetic path clearing positions as shown in FIG. 23. As a result, magnetic path 302 is not blocked by any of magnetism masking elements 301*a*, 301*b*, or 301*c*, and a paper passage area of the entire width (A3 size width) of fixing belt 210 is heated. Here, FIG. 23 is a cross-sectional view showing the opposed core shown in FIG. 22 cut through plane E.

In a paper-passage mode of B4 size recording paper 109, the shortest of magnetism masking elements 301*a*, 301*b*, and 301*c*—that is, magnetism masking elements 301*c*—are positioned at the above-described magnetic path blocking position as shown in FIGS. 25A and 25B. As a result, magnetic path 302 is blocked by magnetism masking elements 301*c*, and only a paper passage area of fixing belt 210 corresponding to a B4 size width is heated. Magnetism masking elements 301*a* and 301*b* are both withdrawn to their magnetic path clearing positions, preventing temperature unevenness due to them within the paper passage area. Here, FIG. 25A is a cross-sectional view showing the opposed core shown in FIG. 24 cut through plane F, and FIG. 25B is a cross-sectional view showing the opposed core shown in FIG. 24 cut through plane G.

In A4 size recording paper 109 paper-passage mode, the medium-length magnetism masking elements among magnetism masking elements 301*a*, 301*b*, and 301*c*—that is, magnetism masking elements 301*a*—are positioned at the above-described magnetic path blocking position as shown in FIGS. 27A and 27B. As a result, magnetic path 302 is blocked by magnetism masking elements 301*a*, and only a paper passage area of fixing belt 210 corresponding to an A4 size width is heated. Magnetism masking elements 301*b* and 301*c* are both withdrawn to their magnetic path clearing positions, preventing temperature unevenness due to them within the paper passage area. Here, FIG. 27A is a cross-sectional view showing the opposed core shown in FIG. 26 cut through plane H, and FIG. 27B is a cross-sectional view showing the opposed core shown in FIG. 26 cut through plane I.

In a paper-passage mode of A5 size recording paper 109, the longest of magnetism masking elements 301*a*, 301*b*, and 301*c*—that is, magnetism masking elements 301*b*—is positioned at the above-described magnetic path blocking position as shown in FIGS. 29A and 29B. As a result, magnetic path 302 is blocked by magnetism masking elements 301*b*, and only a paper passage area of fixing belt 210 corresponding to an A5 size width is heated. Magnetism masking elements 301*a* and 301*c* are both withdrawn to their magnetic path clearing positions, preventing temperature unevenness due to them within the paper passage area. Here, FIG. 29A is a cross-sectional view showing the opposed core shown in FIG. 28 cut through plane J, and FIG. 29B is a cross-sectional view showing the opposed core shown in FIG. 28 cut through plane K.

Figure 30:
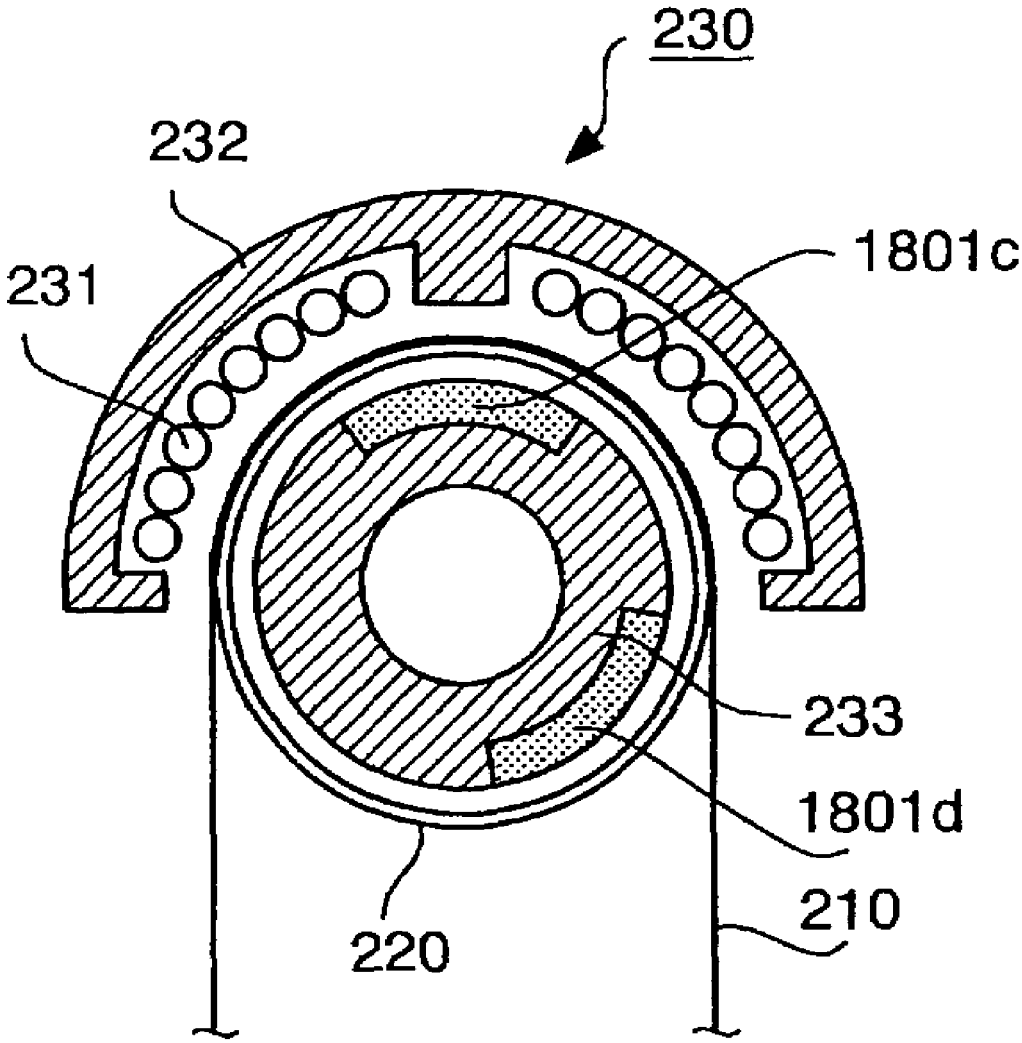
FIG. 30 is a schematic cross-sectional view showing the configuration of the principal parts of a fixing apparatus in which two magnetism masking elements have lengths corresponding to A4 size width and B4 size width paper non-passage areas.

As shown in FIG. 30, two magnetism masking elements 1801*c* and 1801*d* may also have lengths corresponding respectively to A size width and B4 size width paper non-passage areas. With such an embodiment, since magnetism masking elements 1801*c* and 1801*d* form the same plane with the surface of opposed core 233, thermal conduction from fixing belt 210 to opposed core 233 and thermal conduction from fixing belt 210 to magnetism masking elements 1801*c* and 1801*d* are equal, and the occurrence of temperature unevenness of fixing belt 210 can be prevented. Also, magnetism masking element width W1 (circumferential length) can be made greater than when three magnetism masking elements are used. That is to say, magnetic flux passing through paper non-passage areas of fixing belt 210 can be masked more effectively, and an excessive rise in temperature due to accumulation of heat in paper non-passage areas of fixing belt 210 can be prevented more surely.

Figure 31A:
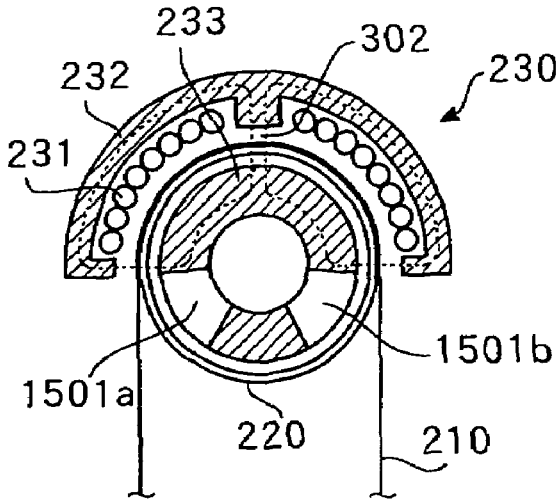
FIG. 31A is a schematic cross-sectional view showing the positions of cutaway parts of an opposed core corresponding to an A3 size recording paper paper-passage mode of a fixing apparatus according to Embodiment 11 of the present invention.
Figure 31B:
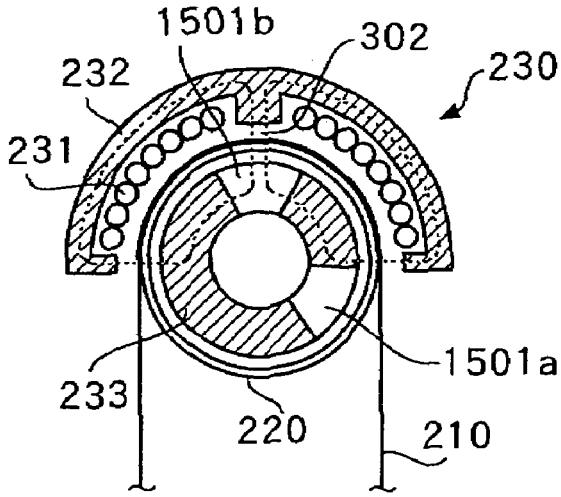
FIG. 31B is a schematic cross-sectional view showing the positions of cutaway parts of an opposed core corresponding to a B4 size recording paper paper-passage mode of a fixing apparatus.
Figure 31C:
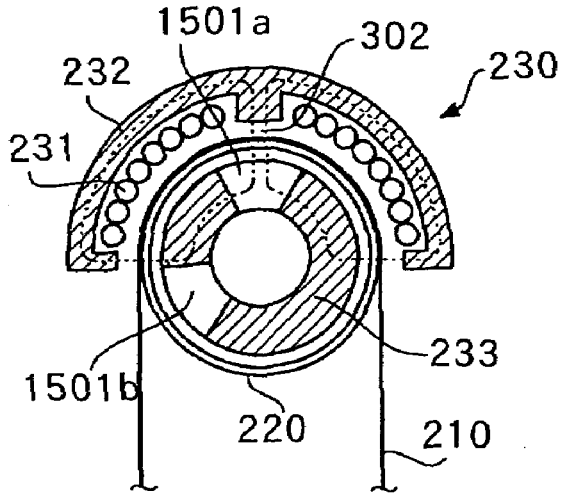
FIG. 31C is a schematic cross-sectional view showing the positions of cutaway parts of an opposed core corresponding to an A4 size recording paper paper-passage mode of a fixing apparatus.

The above-described paper-passage modes can also be supported by a fixing apparatus in which the above-described magnetism masking elements are configured as cutaway parts 1501 or recesses 1701. FIGS. 31A, 31B, and 31C are schematic cross-sectional views illustrating three paper-passage modes when the aforementioned magnetism masking elements are configured as two cutaway parts 1501*a* and 1501*b*.

In FIGS. 31A, 31B, and 31C, if cutaway parts 1501*a* are taken as corresponding to magnetism masking elements 301*a*, and cutaway parts 1501*b* are taken as corresponding to magnetism masking elements 301*c*, in A3 size recording paper 109 paper-passage mode, cutaway parts 1501*a* and 1501*b* are all withdrawn to the above-described magnetic path clearing positions as shown in FIG. 31A. As a result, magnetic path 302 is not blocked by cutaway parts 1501*a* or 1501*b* and a paper passage area of the entire width (A3 size width) of fixing belt 210 is heated.

Also, in a paper-passage mode of B4 size recording paper 109, the shortest of cutaway parts 1501*a* and 1501*b*—that is, cutaway parts 1501*b*—are positioned at the above-described magnetic path blocking position as shown in FIG. 31B. As a result, magnetic path 302 is blocked by cutaway parts 1501*b*, and only a paper passage area of fixing belt 210 corresponding to a B4 size width is heated.

Furthermore, in a 109 paper-passage mode of A4 size recording paper 109, the longest of cutaway parts 1501*a* and 1501*b*—that is, cutaway parts 1501*a*—are positioned at the above-described magnetic path blocking position as shown in FIG. 31C. As a result, magnetic path 302 is blocked by cutaway parts 1501*a*, and only a paper passage area of fixing belt 210 corresponding to an A4 size width is heated.

According to this fixing apparatus, it is possible to perform continuous heat-fixing of A3 size images and A4 size images as business documents, and continuous heat-fixing of B4 size images as official documents and school teaching materials, enabling this fixing apparatus to be used as a fixing apparatus of a multifunctional image forming apparatus.

Figure 32:
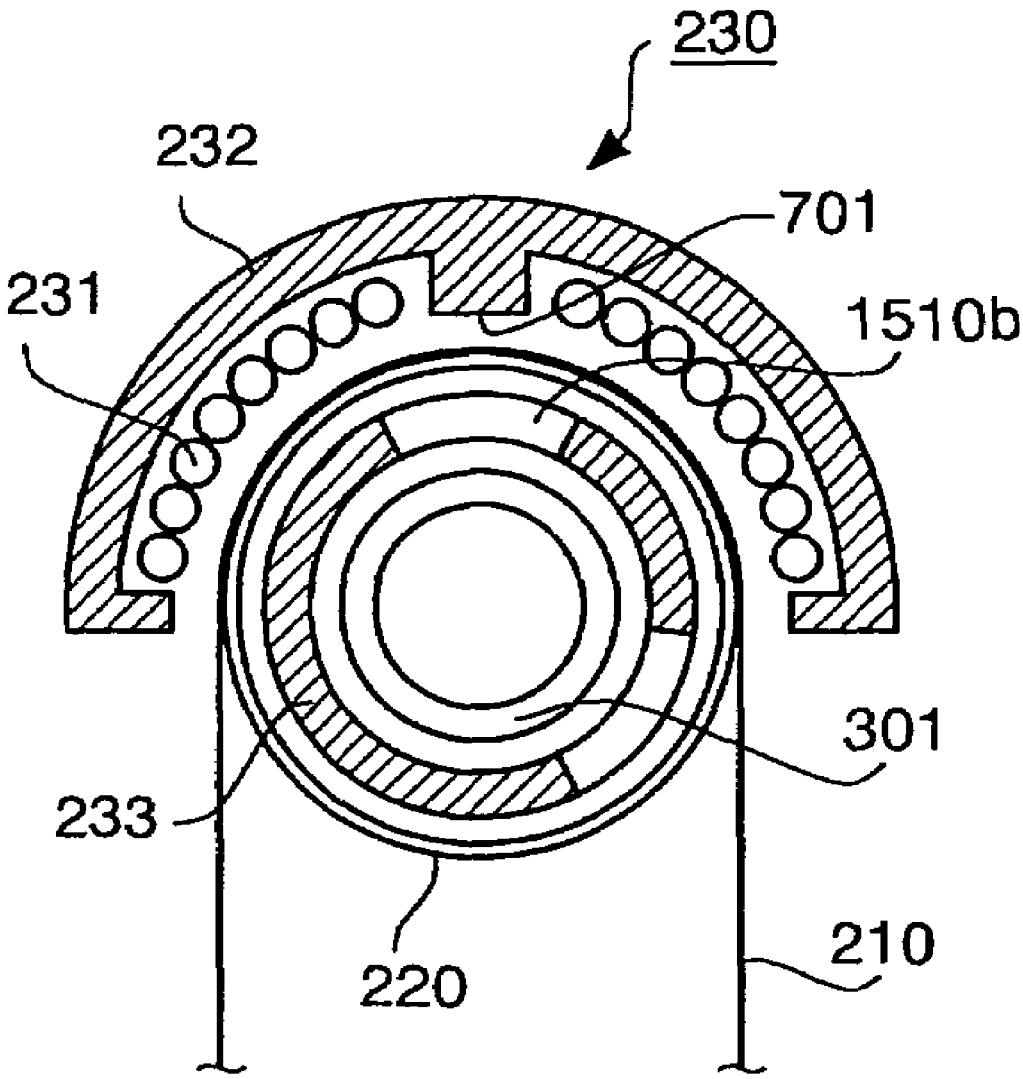
FIG. 32 is a schematic cross-sectional view showing the configuration of the principal parts of a fixing apparatus in which magnetism masking elements are provided inside the opposed core shown in FIGS. 31A, 31B, and 31C.

As shown in FIG. 32, a tubular magnetism masking element 301 may also be provided inside opposed core 233 shown in FIGS. 31A, 31B, and 31C. With such an embodiment, magnetism masking element 301 faces center core 701 via cutaway parts 1501*b* provided in opposed core 233 by rotating opposed core 233 to be at predetermined position, as shown in FIG. 32, enabling magnetic flux to be masked more efficiently. In this sample variation, magnetism masking element 301 need not move, and may therefore be fixed. Also, in this sample variation, an example has been described in which a magnetic path is blocked or cleared by rotating opposed core 233, but this is not a limitation, and a magnetic alloy that loses its magnetic properties when its temperature rises may be used instead of opposed core 233. If the temperature of paper non-passage areas of fixing belt 210 rises and the temperature of the magnetic alloy exceeds the Curie point, the magnetic properties of paper non-passage area of the magnetic alloy are lost, and magnetic paths of paper non-passage areas are blocked by magnetism masking element 301. With this sample variation, blocking and clearing of magnetic path are performed automatically, which has the effect of making displacement mechanism 500 unnecessary.

Embodiment 12

Figure 33:
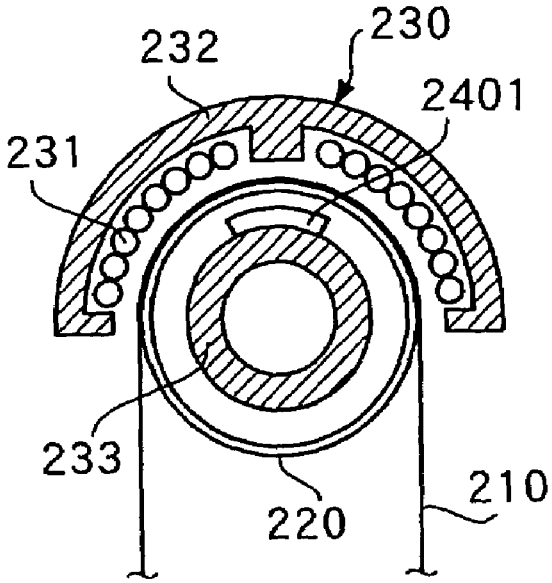
FIG. 33 is a schematic cross-sectional view of principal parts showing the configuration of a fixing apparatus according to Embodiment 12 of the present invention.
Figure 34:
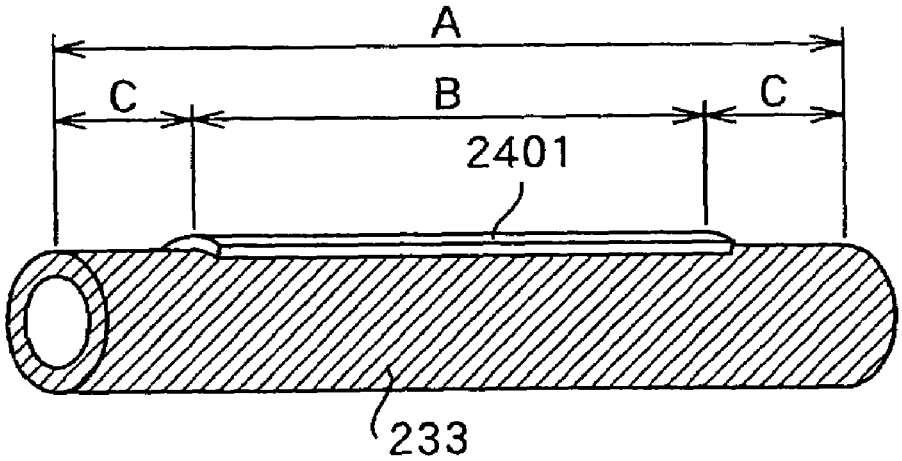
FIG. 34 is a schematic oblique drawing showing a paper passage area magnetism masking element of an opposed core of a fixing apparatus according to Embodiment 12 of the present invention.

Next, a fixing apparatus according to Embodiment 12 will be described. As shown in FIG. 33 and FIG. 34, this fixing apparatus has a configuration in which a paper passage area magnetism masking element 2401 with a length corresponding to a paper passage area width smaller than the maximum paper passage area width of fixing belt 210 is provided in a position corresponding to the paper passage area of fixing belt 210.

In this fixing apparatus, paper non-passage areas can be made to rise in temperature by blocking magnetic path 302 with paper passage area magnetism masking element 2401. If the temperature of paper non-passage areas of fixing belt 210 for which heat production has been prevented by above-described magnetism masking elements 301 becomes too low, the temperature can be raised to a predetermined fixing temperature in a short time by means of paper passage area magnetism masking element 2401.

Embodiment 13

Figure 35:
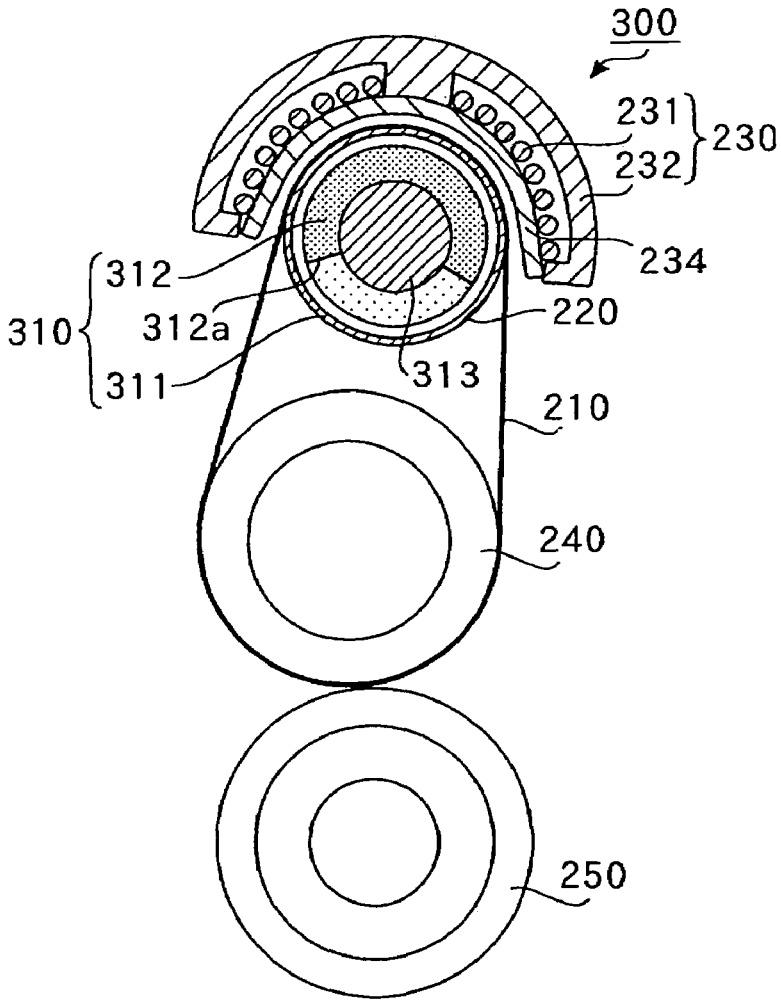
FIG. 35 is a schematic cross-sectional view showing the configuration of a fixing apparatus according to Embodiment 13 of the present invention.

Next, a fixing apparatus according to Embodiment 13 of the present invention will be described. FIG. 35 is a schematic cross-sectional view showing the configuration of a fixing apparatus according to Embodiment 13 of the present invention. In a fixing apparatus 300 according to Embodiment 13, supporting roller 220 is configured as a member that does not mask but allows passage of magnetic flux generated by excitation apparatus 230, composed of the aforementioned non-magnetic stainless material (SUS304) with a specific resistance of 72 μΩcm, for example. As shown in FIG. 35, this fixing apparatus 300 is provided with magnetic flux control sections 310 that control heat production distribution in the paper passage width direction (lengthwise direction) of fixing belt 210 by absorbing or repelling magnetic flux that has passed through supporting roller 220.

Figure 36:
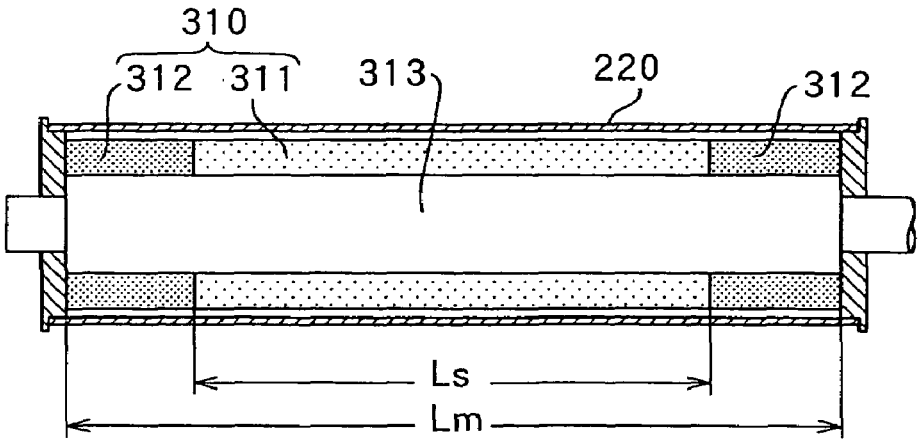
FIG. 36 is a schematic cross-sectional view showing the configuration of a magnetic flux control mechanism of a fixing apparatus according to Embodiment 13 of the present invention.
Figure 37:
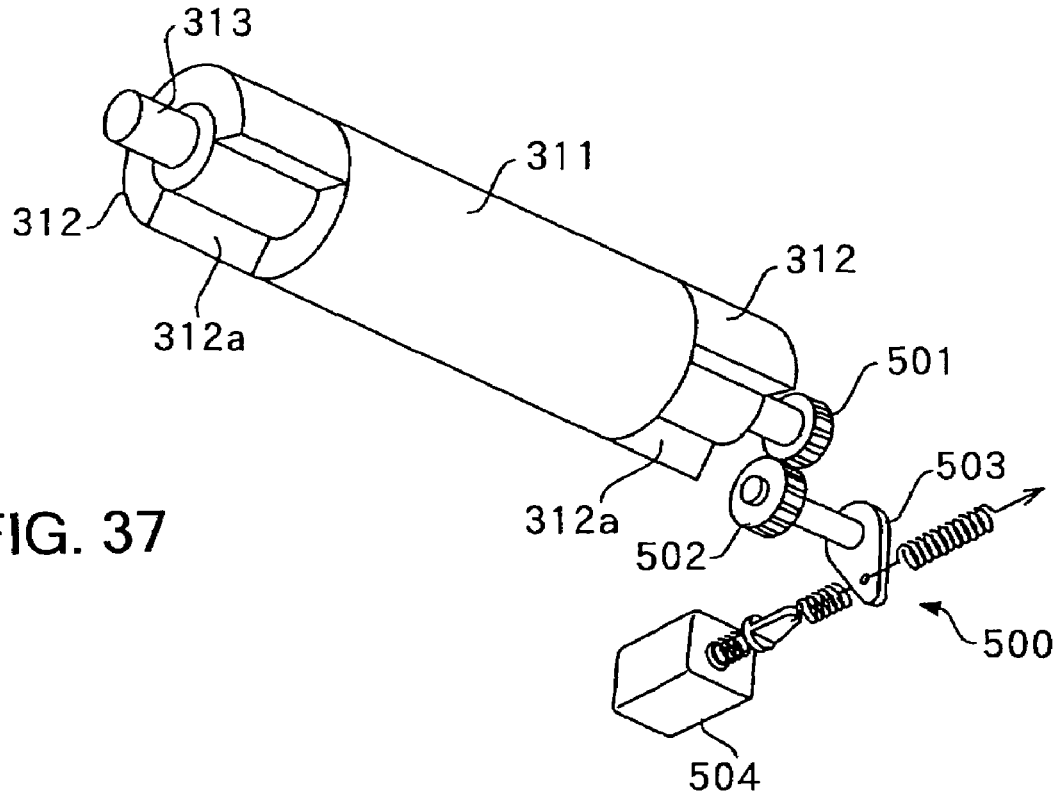
FIG. 37 is a schematic oblique drawing showing the configuration of a magnetic flux control section of a fixing apparatus according to Embodiment 13 of the present invention.

As shown in FIG. 36 and FIG. 37, these magnetic flux control sections 310 are located inside supporting roller 220, and are configured by providing a small-size width control member 311 corresponding to a small-size paper (for example, A4) size recording paper width, and maximum width control members 312 corresponding to the maximum-size paper (for example, A3) size recording paper width, on a switchover shaft 313.

Small-size width control member 311 and maximum width control members 312 comprise ferrite cores, and small-size width control member 311 shown in the drawings is configured as a cylinder with a perfectly circular cross-section. Maximum width control members 312 shown in the drawings comprise ferrite cores with a fan-shaped cross-section with cutaway parts 312*a* provided in part of the axial direction.

A magnetic flux control section 310 is not limited to the configuration of this embodiment, and it is possible to use a configuration in which an electrical conductor such as aluminum or copper is embedded in a cutaway part of a maximum width control member 312, and magnetic flux in this part is reduced more effectively, or a configuration in which items that absorb or repel magnetic flux—such as items in which an aluminum or copper sheet is provided only in a part corresponding to a cutaway part—are combined as appropriate without using a ferrite core.

The position of a small-size width control member 311 and a maximum width control member 312 on switchover shaft 313 is decided in accordance with the recording paper 109 paper passage reference For example, when the recording paper 109 paper passage reference is a center reference, a small-size width control member 311 is provided in the center of switchover shaft 313 and a maximum width control member 312 is provided at either side of small-size width control member 311 as shown in FIG. 35 and FIG. 36.

Switchover shaft 313 is rotated through a predetermined angle (in the example shown in the drawings, an angle of approximately 180 degrees) by displacement mechanism 500 shown in FIG. 37 in accordance with the size of recording paper 109 passed through. Displacement mechanism 500 shown in the drawing is composed of a small gear wheel 501 attached to switchover shaft 313, a large gear wheel 502 that meshes with small gear wheel 501, an arm 503 integral with the spindle of large gear wheel 502, a solenoid 504 that causes arm 503 to swing, and so forth.

In FIG. 37, when solenoid 504 is turned on (energized), the actuator of solenoid 504 moves and arm 503 swings. Through this swinging of arm 503, large gear wheel 502 rotates, and small gear wheel 501 rotates driven by large gear wheel 502. Through this driven rotation of small gear wheel 501, switchover shaft 313 rotates, and the position of cutaway parts 312*a* of maximum width control members 312 is inverted by approximately 180 degrees. When solenoid 504 is turned off (de-energized) in this state, arm 503 returns to its initial position, large gear wheel 502, small gear wheel 501, and switchover shaft 313 are all rotated backward, and cutaway parts 312*a* of maximum width control members 312 are restored to their original position.

Thus, in magnetic flux control section 310 of fixing apparatus 300 according to Embodiment 13, by turning solenoid 504 of displacement mechanism 500 on and off, the position of cutaway parts 312*a* of maximum width control members 312 is inverted, and the strength of magnetic coupling in the paper passage width direction between fixing belt 210 and exciting coil 231 is controlled.

That is to say, when the size of recording paper 109 passed through is the maximum size, solenoid 504 is left in the off state in FIG. 37, and both small-size width control member 311 and maximum width control members 312 are made to face exciting coil 231 of excitation apparatus 230. Consequently, as shown in FIG. 35 and FIG. 36, magnetic flux that is generated by excitation apparatus 230 and passes through supporting roller 220 is absorbed over whole of maximum paper passage width Lm of supporting roller 220 by small-size width control member 311 and maximum width control members 312 and acts on the entire maximum paper passage width of fixing belt 210, and heat production distribution in the paper passage width direction of fixing belt 210 is kept uniform over the entire maximum paper passage width.

On the other hand, when the size of recording paper 109 passed through is a small size, solenoid 504 is turned on in FIG. 37, the position of maximum width control members 312 is reversed so that the position of their cutaway parts 312*a* is opposite to exciting coil 231, and only small-size width control member 311 corresponding to a small-size recording paper width is made to face exciting coil 231 of excitation apparatus 230. Consequently, as shown in FIG. 36, magnetic flux that is generated by excitation apparatus 230 and passes through supporting roller 220 is well absorbed over small-size paper passage width Ls of supporting roller 220 only by small-size width control member 311 and acts only on the small-size paper passage width of fixing belt 210. As a result, magnetic coupling with exciting coil 231 in paper non-passage areas of fixing belt 210 decreases, heat production of paper non-passage areas of fixing belt 210 is suppressed more than heat production of small-size paper passage width "Ls" of fixing belt 210, and an excessive rise in temperature of paper non-passage areas of fixing belt 210 can be prevented.

Thus, with fixing apparatus 300 according to Embodiment 13, since supporting roller 220 allows passage of magnetic flux, by selectively reversing the position of cutaway parts 312*a* of maximum width control members 312 in accordance with the size of recording paper 109, magnetic flux passing through supporting roller 220 can be partially increased or decreased, and heat production distribution in the paper passage width direction of fixing belt 210 can easily be controlled.

Embodiment 14

Figure 38:
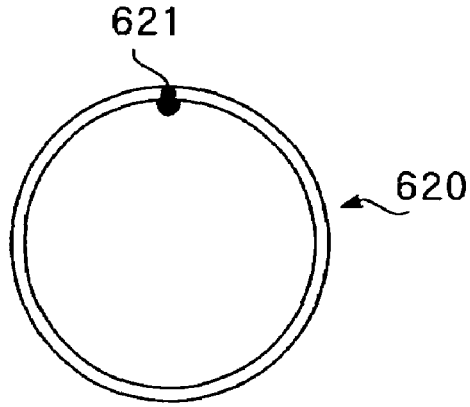
FIG. 38 is a schematic cross-sectional view showing the configuration of a supporting roller of a fixing apparatus according to Embodiment 14 of the present invention.
Figure 39:
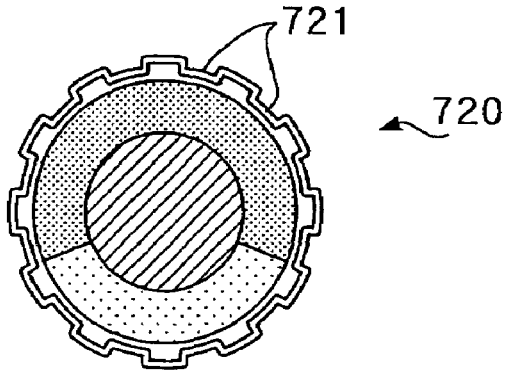
FIG. 39 is a schematic cross-sectional view showing the configuration of another supporting roller of a fixing apparatus according to Embodiment 14 of the present invention.

Next, a fixing apparatus according to Embodiment 14 will be described. FIG. 38 and FIG. 39 are schematic cross-sectional views showing the configuration of a supporting roller of a fixing apparatus according to Embodiment 14 of the present invention.

As shown in FIG. 38, a configuration is used for a supporting roller 620 of a fixing apparatus according to Embodiment 14 in which a thin metal sheet is formed into a cylindrical shape, and a joint 621 is welded. This fixing apparatus can be configured inexpensively since a welded tube is used as its supporting roller 620.

Also, as shown in FIG. 39, an item in which rib-shaped reinforcing grooves 721 formed along the direction of the generating line of the cylinder can be used as a supporting roller 720 of this Embodiment. In this fixing apparatus, supporting roller 720 can be configured with high bending strength using a thin material of small thermal capacity. For example, a supporting roller with small thermal capacity and high bending strength can be formed by forming rib-shaped reinforcing grooves 721 even when a thin material not exceeding 100 μm in thickness is used.

However, in the case of supporting roller 620 configured as a welded tube as shown in FIG. 38, joint 621 and non-joint parts have different thermal capacities, and therefore temperature unevenness occurs in its surface temperature. Also, in the case of supporting roller 720 on which rib-shaped reinforcing grooves 721 are formed as shown in FIG. 39, the amount of thermal conduction from fixing belt 210 is different for a part touching fixing belt 210 and a part not touching fixing belt 210, and therefore temperature unevenness occurs in its surface temperature.

Thus, a fixing apparatus according to Embodiment 14 is configured so that the circumference of fixing belt 210 is not an integral multiple of the circumference of supporting roller 620 or supporting roller 720. In a fixing apparatus with this configuration, the rotational period of fixing belt 210 is different from the rotational period of supporting roller 620 or supporting roller 720, and the point of contact between supporting roller 620 or supporting roller 720 and fixing belt 210 during rotation of fixing belt 210 changes successively. Therefore, according to a fixing apparatus with this configuration, even if temperature unevenness occurs in supporting roller 620 or 720, since the heat of supporting roller 620 or 720 is not conducted to and accumulated at a fixed place, the surface temperature of fixing belt 210 can be smoothed so as to be free of unevenness.

Embodiment 15

Figure 40:
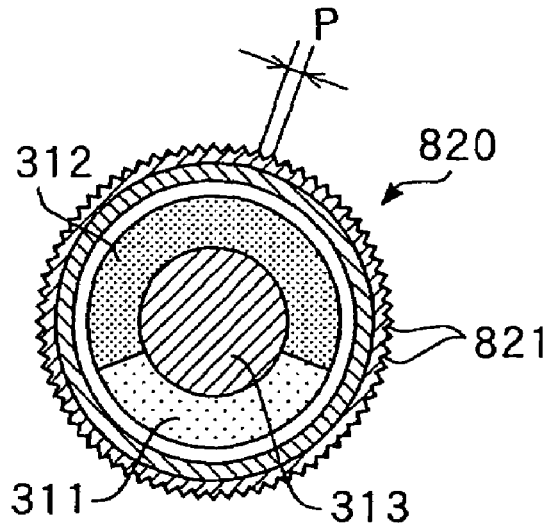
FIG. 40 is a schematic cross-sectional view showing the configuration of a supporting roller of a fixing apparatus according to Embodiment 15 of the present invention.

Next, a fixing apparatus according to Embodiment 15 will be described. FIG. 40 is a schematic cross-sectional view showing the configuration of a supporting roller of a fixing apparatus according to Embodiment 15 of the present invention.

As shown in FIG. 40, a supporting roller 820 of a fixing apparatus according to Embodiment 15 is configured by forming knurl-shaped projections and depressions 821 on the outer surface of a cylinder. With this fixing apparatus, the area of contact between supporting roller 820 and fixing belt 210 can be minimized.

Therefore, with a fixing apparatus according to Embodiment 15, thermal insulation between fixing belt 210 and supporting roller 820 can be improved, there is little loss of heat production energy of fixing belt 210 during warming-up, and the startup time can be shortened.

However, with supporting roller 820 on which projections and depressions 821 are formed in this way, if the rotational period coincides between pitch P of these projections and depressions 821 and fixing belt 210, the point of contact between projections and depressions 821 of supporting roller 820 and fixing belt 210 during rotation of fixing belt 210 will always be the same, and temperature unevenness will occur in the surface temperature.

Thus, a fixing apparatus according to Embodiment 15 is configured so that the circumference of fixing belt 210 is not an integral multiple of pitch P of projections and depressions 821.

In a fixing apparatus with this configuration, since the circumference of fixing belt 210 is not an integral multiple of pitch P of projections and depressions 821, the point of contact between supporting roller 820 and fixing belt 210 during rotation of fixing belt 210 changes successively. Therefore, according to this fixing apparatus, even if temperature unevenness occurs in the surface temperature of supporting roller 820, the heat of supporting roller 820 is not accumulated at a fixed point of fixing belt 210, and the surface temperature of fixing belt 210 can be smoothed so as to be free of unevenness.

Embodiment 16

Figure 41:
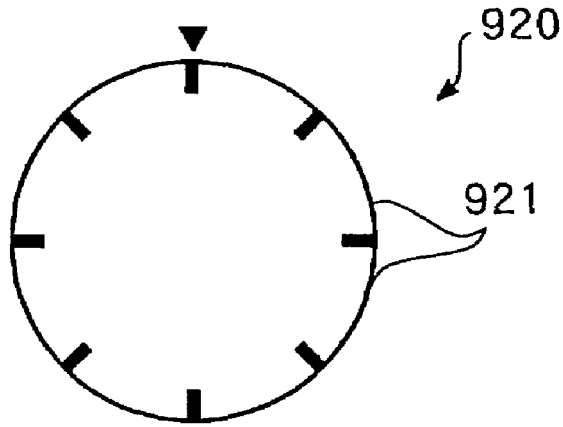
FIG. 41 is a schematic cross-sectional view showing the configuration of a supporting roller of a fixing apparatus according to Embodiment 16 of the present invention.

Next, a fixing apparatus according to Embodiment 16 will be described. FIG. 41 is a schematic cross-sectional view showing the configuration of a supporting roller of a fixing apparatus according to Embodiment 16 of the present invention.

Figure 42:
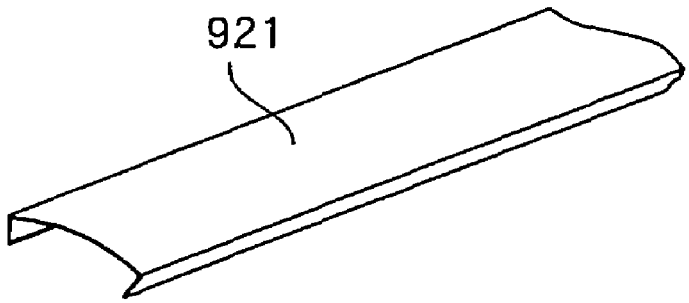
FIG. 42 is a schematic oblique drawing showing a plate that is a component of a supporting roller of a fixing apparatus according to Embodiment 16 of the present invention.

As shown in FIG. 41, a supporting roller 920 of a fixing apparatus according to Embodiment 16 is configured, for example, by combining a plurality of sheets 921 comprising channel-shaped thin metal sheets such as shown in FIG. 42 into a cylindrical shape.

In a fixing apparatus configured in this way, since supporting roller 920 is configured using a plurality of sheets 921 comprising channel-shaped thin metal sheets, supporting roller 920 can be given a configuration with small thermal capacity and high bending strength. Also, according to this fixing apparatus, the outer diameter of supporting roller 920 can easily be changed by changing the quantity of sheets 921 making up supporting roller 920.

Embodiment 17

Figure 43:
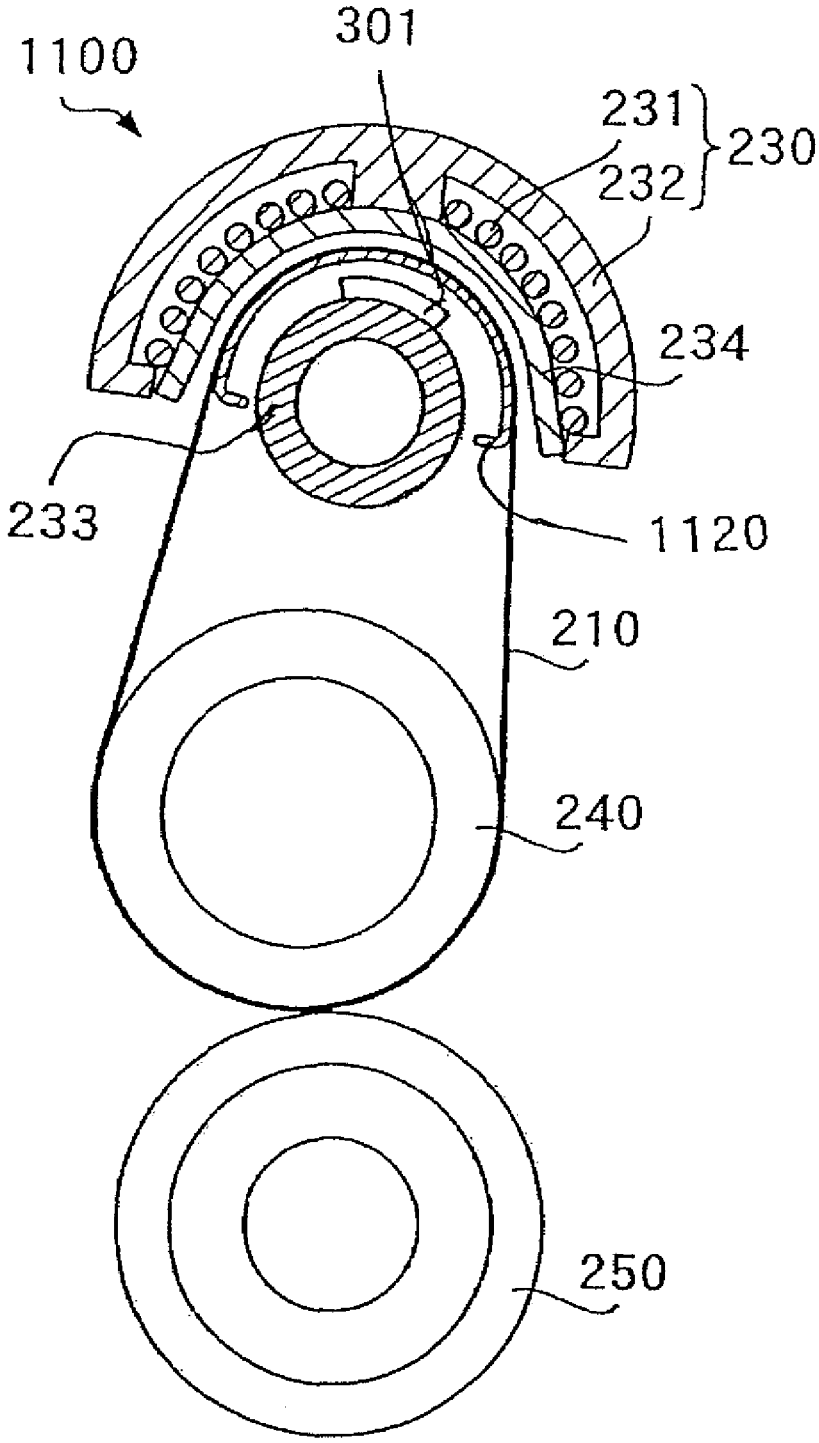
FIG. 43 is a schematic cross-sectional view showing the configuration of a fixing apparatus according to Embodiment 17 of the present invention.

Next, a fixing apparatus according to Embodiment 17 will be described. FIG. 43 is a schematic cross-sectional view showing the configuration of a fixing apparatus according to Embodiment 17 of the present invention.

As shown in FIG. 43, in a fixing apparatus 1100 according to Embodiment 17, a belt supporting member over which fixing belt 210 is suspended is configured, for example, as a guide member 1120 in which a sheet comprising a thin metal sheet is formed into an arc shape.

With this image forming apparatus 1100, the space occupied by guide member 1120 constituting a belt supporting member is smaller than when the aforementioned belt supporting member is configured as a supporting roller, enabling the circumference of fixing belt 210 to be minimized. Also in this fixing apparatus 1100, guide member 1120 constituting a belt supporting member can be configured with smaller thermal capacity and less expensively than in the case of the aforementioned supporting roller. This guide member 1120 may be configured, for example, by cutting away part of supporting roller 920 configured with a plurality of sheets 921 comprising channel-shaped thin metal sheets shown in FIG. 42.

The supporting rollers shown in above-described Embodiment 13 through Embodiment 17 can be applied to a heating apparatus other than a fixing apparatus of an image forming apparatus.

The present application is based on Japanese Patent Application No. 2003-358024, filed on Oct. 17, 2003, Japanese Patent Application No. 2003-358330, filed on Oct. 17, 2003, and Japanese Patent Application No. 2004-155165, filed on May 25, 2004, the entire content of which is expressly incorporated herein by reference.

INDUSTRIAL APPLICABILITY

A fixing apparatus according to the present invention enables diverted flow of magnetic flux from a paper passage area of a heat-producing member to a paper non-passage area to be eliminated and an excessive rise in temperature of that paper non-passage area to be prevented, without enlarging the apparatus, and is therefore useful as a fixing apparatus of an electrophotographic or electrostatographic copier, facsimile machine, printer, or the like.

The invention claimed is:

1. A fixing apparatus comprising:

a magnetic flux generation section that generates magnetic flux;

a heat-producing element of a nonmagnetic electrical conductor, that allows passage of the magnetic flux and is induction-heated;

at least one magnetism masking element that masks the magnetic flux; and a magnetic flux adjustment section that switches between masking and clearing of magnetic flux with respect to a paper non-passage area of said heat-producing element, wherein said magnetism masking element is located on the opposite side of said magnetic flux generation section across the heat-producing element, and, when said heat-producing element produces heat, said magnetism masking element is positioned, by said magnetic flux adjustment section, at a position where the magnetic flux is masked with respect to a paper non-passage area of said heat-producing element and suppresses heat in the paper non-passage area.

2. The fixing apparatus according to claim 1 further, comprising an opposed core located on the opposite side of said magnetic flux generation section across the heat-producing element, wherein said magnetism masking element moves relative to said magnetic flux generation section in a direction of movement of said heat-producing element, and is displaced between a magnetic path blocking position at which a magnetic path corresponding to a paper non-passage area of said heat-producing element between said magnetic flux generation section and the opposed core is blocked, and a magnetic path clearing position at which the magnetic path is cleared.

3. The fixing apparatus according to claim 1, wherein:

said heat-producing element is formed in a circular shape; and said magnetism masking element is located inside the circle formed by said heat-producing element; and said magnetic flux generation section is located outside the circle.

4. The fixing apparatus according to claim 1, wherein:

said magnetic flux generation section comprises:

an exciting coil that comprises windings; and a center core located in a center of windings of the exciting coil; and a width of said magnetism masking element in a direction of movement relative to said magnetic flux generation section is greater than a width of the center core in the same direction.

5. The fixing apparatus according to claim 4, wherein the width of said magnetism masking element in a direction of movement relative to the magnetic flux generation section is narrower than a winding width of a winding section of the exciting coil in the same direction.

6. The fixing apparatus according to claim 5, wherein at least one magnetic path clearing position of said magnetism masking element is a position at which said magnetism masking element is opposite the winding section of the exciting coil.

7. The fixing apparatus according to claim 4, wherein a magnetic path blocking position at which a magnetic path of a paper non-passage area of said heat-producing element is blocked by said magnetism masking element is a position at which said magnetism masking element is opposite the center of the windings of the exciting coil.

8. The fixing apparatus according to claim 1, wherein:

said magnetic flux generation section comprises an exciting coil that comprises windings; and a width of said magnetism masking element in a direction of movement relative to said magnetic flux generation section is greater than a width of a center of windings of the exciting coil in the same direction.

9. The fixing apparatus according to claim 8, wherein the width of said magnetism masking element in a direction of movement relative to said magnetic flux generation section is narrower than a winding width of a winding section of the exciting coil in the same direction.

10. The fixing apparatus according to claim 9, wherein at least one magnetic path clearing position of said magnetism masking element is a position at which said magnetism masking element is opposite the winding section of the exciting coil.

11. The fixing apparatus according to claim 8, wherein a magnetic path blocking position at which a magnetic path of a paper non-passage area of said heat-producing element is blocked by said magnetism masking element is a position at which said magnetism masking element is opposite the center of the windings of the exciting coil.

12. The fixing apparatus according to claim 1, comprising a plurality of said magnetism masking elements having lengths corresponding to each of a plurality of paper non-passage areas of mutually different widths of said heat-producing element.

13. The fixing apparatus according to claim 12, wherein:

the plurality of said magnetism masking element are provided on a rotating element that rotates freely relative to said magnetic flux generation section; and an angle forming a normal line passing through centers of two mutually adjacent magnetism masking elements is set to an angle of either 30 degrees<θ3<60degrees or 120 degrees <θ4<180degrees.

14. The fixing apparatus according to claim 1, further comprising an opposed core located opposite said magnetic flux generation section, wherein said magnetism masking element is provided on the opposed core that is rotatable relative to said magnetic flux generation section.

15. The fixing apparatus according to claim 2, wherein said magnetism masking element is formed by a cutaway part provided in the opposed core.

16. The fixing apparatus according to claim 2, wherein said magnetism masking element comprises a recess provided in the opposed core.

17. The fixing apparatus according to claim 15, wherein an electrical conductor is embedded in the cutaway part.

18. The fixing apparatus according to claim 17, wherein the electrical conductor is coplanar with a surface of the opposed core.

19. The fixing apparatus according to claim 16, wherein an electrical conductor is embedded in the recess.

20. The fixing apparatus according to claim 19, wherein the electrical conductor is formed flush with a surface of the opposed core.

21. The fixing apparatus according to claim 12, wherein the plurality of said magnetism masking elements have lengths corresponding to each of A3 size width, A4 size width, and B4 size width paper non-passage areas of said heat-producing element.

22. The fixing apparatus according to claim 1 further, comprising a paper passage area magnetism masking element having a length corresponding to a paper passage area width smaller than a width of a maximum paper passage area of said heat-producing element, wherein the paper passage area magnetism masking element is placed in a position corresponding to a paper passage area of said heat-producing element.

23. The fixing apparatus according to claim 1, wherein:

said heat-producing element is configured as an endless belt; and a belt supporting member on which the endless belt is supported comprises a member that allows passage of magnetic flux.

24. The fixing apparatus according to claim 23, wherein the belt supporting member comprise a metallic material with a thickness in a range of 0.04mm to 0.2mm in a direction perpendicular to a peripheral surface of the endless belt.

25. The fixing apparatus according to claim 23, wherein the belt supporting member has a specific resistance of 50 μΩcm or more.

26. The fixing apparatus according to claim 23, wherein the belt supporting member comprises a nonmagnetic stainless material.

27. The fixing apparatus according to claim 23, wherein the belt supporting member comprises a rotatable supporting roller comprising a sheet formed into a cylindrical shape and joint welded.

28. The fixing apparatus according to claim 23, wherein the belt supporting member comprises a rotatable supporting roller in which rib-shaped reinforcing grooves are provided in a direction of a generating line of a cylinder.

29. The fixing apparatus according to claim 23, wherein a circumference of the endless belt is a non-integral multiple of an outer circumference of the supporting roller.

30. The fixing apparatus according to claim 23, wherein the belt supporting member comprises a rotatable supporting roller in which knurl-shaped projections and depressions are formed on an outer surface of a cylinder.

31. The fixing apparatus according to claim 30, wherein:

the projections and depressions have a predetermined pitch in a circumferential direction of the supporting roller; and a circumference of the endless belt is a non-integral multiple of a pitch of the projections and depressions.

32. The fixing apparatus according to claim 23, wherein the belt supporting member comprises a supporting roller in which a plurality of channel-shaped sheets are combined into a cylindrical shape.

33. The fixing apparatus according to claim 23, wherein the belt supporting member comprises a guide member in which a sheet is formed into an arc shape.

34. An image forming apparatus comprising the fixing apparatus according to claim 1.

35. The fixing apparatus according to claim 1, wherein said heat-producing element comprises a thin copper material.

36. The fixing apparatus according to claim 1, wherein said magnetism masking element comprises an electrical conductor.

37. The fixing apparatus according to claim 1, wherein said magnetism masking element comprises a copper material.

38. The fixing apparatus according to claim 1, wherein said magnetism masking element comprises an aluminum material.

* * * * *